US010330054B2

(12) United States Patent
Beyer et al.

(10) Patent No.: US 10,330,054 B2
(45) Date of Patent: Jun. 25, 2019

(54) SYSTEMS AND METHOD FOR AN EXHAUST GAS RECIRCULATION COOLER COUPLED TO A CYLINDER HEAD

(71) Applicant: Ford Global Technologies, LLC, Dearborn, MI (US)

(72) Inventors: Theodore Beyer, Canton, MI (US); Charles Joseph Patanis, South Lyon, MI (US); Jody Michael Slike, Farmington Hills, MI (US); William Spence, Warren, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 337 days.

(21) Appl. No.: 15/080,289

(22) Filed: Mar. 24, 2016

(65) Prior Publication Data

US 2017/0276095 A1 Sep. 28, 2017

(51) Int. Cl.
*F02M 26/30* (2016.01)
*F02M 26/32* (2016.01)
*F02M 26/41* (2016.01)

(52) U.S. Cl.
CPC ..... *F02M 26/30* (2016.02); *F02M 26/32* (2016.02); *F02M 26/41* (2016.02)

(58) Field of Classification Search
CPC ..... F02M 26/28; F02M 26/29; F02M 26/30; F02M 26/32; F02M 26/41
USPC ..... 123/568.12, 568.13
See application file for complete search history.

(56) References Cited

U.S. PATENT DOCUMENTS 4,134,377 A * 1/1979 Bamsey ..... F02M 26/58 123/568.12
4,156,414 A * 5/1979 Kawamura ..... F02B 19/14 123/275
4,258,687 A * 3/1981 Mauch ..... F01P 3/18 123/184.33
4,267,812 A * 5/1981 Aula ..... F02B 47/08 123/184.33
4,328,781 A * 5/1982 Morita ..... F02M 26/41 123/184.39
5,931,131 A * 8/1999 Hackett ..... F02B 47/08 123/195 C (Continued)

FOREIGN PATENT DOCUMENTS

DE 10119484 A1 * 10/2002 ..... F02M 35/10144
DE 102005033023 A1 * 1/2007 ..... F01P 3/12

(Continued)

*Primary Examiner* — John M Zaleskas
(74) *Attorney, Agent, or Firm* — Julia Voutyras; McCoy Russell LLP

(57) ABSTRACT

Methods and systems are provided for an EGR system including an EGR cooler module directly mounted to a cylinder head. In one example, the EGR cooler module includes an EGR inlet port, an EGR outlet port, a coolant inlet port, and a coolant outlet port all arranged parallel with each other and directly mounted to a first side of a cylinder head to interface with passages internal to the cylinder head. In another example, the EGR cool module includes an EGR inlet port and a coolant inlet port parallel to each other and directly mounted to a first side of a cylinder head to interface with passages internal to the cylinder head, while also including an EGR outlet port and a coolant outlet port to interface with passages external to the cylinder head.

18 Claims, 7 Drawing Sheets

(56) References Cited

U.S. PATENT DOCUMENTS 6,102,014 A * 8/2000 Donaldson ..... F02D 13/0276 123/568.12
6,142,116 A * 11/2000 Freese, V ..... F02B 75/22 123/188.14
6,213,074 B1 * 4/2001 Freese ..... F02B 75/22 123/195 C
6,360,702 B1 * 3/2002 Osada ..... F28D 7/0066 123/196 AB
7,363,919 B1 * 4/2008 Styles ..... F01N 5/02 123/568.12
7,625,257 B1 * 12/2009 Broman ..... B63H 20/26 440/89 B
7,926,471 B2 * 4/2011 Freese, V ..... F02M 26/32 123/568.12
7,942,138 B1 * 5/2011 Belter ..... B63H 20/24 123/568.12
8,056,545 B2 11/2011 Feist et al.
8,146,572 B2 * 4/2012 Macfarlane ..... F02D 41/0065 123/568.12
9,752,540 B2 * 9/2017 Lee ..... F02M 26/29
2002/0005190 A1 * 1/2002 Bianchi ..... F02M 26/31 123/568.12
2002/0043254 A1 * 4/2002 Iizuka ..... F02F 1/4214 123/568.13
2003/0230290 A1 * 12/2003 Mackey ..... F02B 75/22 123/568.13
2004/0255918 A1 * 12/2004 Mackey ..... F02B 75/22 123/568.12
2005/0056411 A1 * 3/2005 Dilley ..... F28D 9/0018 165/167
2007/0271910 A1 * 11/2007 Chanfreau ..... F02B 29/0418 60/320
2008/0251242 A1 * 10/2008 Irmler ..... F28D 9/0043 165/164
2008/0257317 A1 * 10/2008 Cerabone ..... F01P 3/12 123/568.12
2009/0120418 A1 * 5/2009 Eibl ..... F01N 3/046 123/568.12
2009/0313972 A1 * 12/2009 Freese, V ..... F02M 26/50 60/278
2011/0315129 A1 * 12/2011 Kojima ..... F02F 1/243 123/568.12
2013/0055970 A1 * 3/2013 Harada ..... F01P 3/20 123/41.79
2013/0319382 A1 * 12/2013 Horie ..... F02D 41/0065 123/568.12
2015/0059715 A1 * 3/2015 Forshier ..... F02M 26/12 123/568.12
2015/0226108 A1 * 8/2015 Vroman ..... F28F 9/027 60/605.2
2016/0025045 A1 * 1/2016 Engineer ..... F02M 26/20 123/568.12
2016/0208745 A1 * 7/2016 Neher ..... F02M 26/31
2016/0265487 A1 * 9/2016 Beyer ..... F02M 35/104
2016/0281649 A1 * 9/2016 Joisten-Pieritz ..... F02M 26/20
2017/0254298 A1 * 9/2017 Beyer ..... F02M 26/30

FOREIGN PATENT DOCUMENTS

DE 102007045542 A1 * 4/2009 ..... F01P 3/02
EP 2063097 A1 * 5/2009 ..... F28D 21/0003
EP 2077388 A2 * 7/2009 ..... F01N 13/105
FR 2855602 A1 * 12/2004 ..... F28D 9/0043
FR 2980823 A1 * 4/2013 ..... F02D 41/0087
FR 2986745 A1 * 8/2013 ..... B60K 5/12
JP 2002285915 A * 10/2002 ..... F02M 26/43
JP 2003065051 A * 3/2003
JP 2005307960 A * 11/2005 ..... F02M 35/10085
JP 2010084581 A * 4/2010
WO 2011025135 A1 3/2011
WO WO 2011141002 A1 * 11/2011 ..... F02M 35/10222

* cited by examiner

SYSTEMS AND METHOD FOR AN EXHAUST GAS RECIRCULATION COOLER COUPLED TO A CYLINDER HEAD

FIELD

The present description relates generally to methods and systems for a cooler for an exhaust gas recirculation (EGR) system of an internal combustion engine.

BACKGROUND/SUMMARY

Internal combustion engines, such as a gasoline engine, produce a variety of waste gases that are expelled from the cylinders through the cylinder head during operation. Some of these gases may be expelled into the atmosphere while some may be recycled by the engine through the use of an exhaust gas recirculation (EGR) system. An EGR system can reduce nitrogen oxide ($NO_x$) emissions to the atmosphere by allowing the engine to replace a portion of its intake gases with exhaust gases. Allowing the EGR system to control the ratio of these gases within the cylinders can effectively lower the temperatures of the cylinders by limiting the amount of combustible intake gas available during each combustion cycle. The reduction in cylinder temperatures provided by an EGR system simultaneously reduces $NO_x$ generation because $NO_x$ forms mainly within a narrow temperature range near peak cylinder temperatures. One problem that arises with such systems is that the gas from the EGR system is relatively hot compared to the intake gas. Hot exhaust gases routed back into the cylinder can lead to degradation of valves, less efficient combustion, and increased cylinder temperatures, thereby cancelling some of the benefits gained through the implementation of the EGR system.

One example of a solution to the problem of recycling hot exhaust gases is to integrate a cooler system within the EGR system. An EGR cooler helps to reduce the temperature of the recycled exhaust gases before they are released into the intake manifold (and in turn, the cylinders). EGR coolers are often comprised of a unit with a series of inlets and outlets for both input and output of EGR gases and coolant. The EGR cooler may be mounted to a surface within the engine compartment, in close proximity to the engine. EGR coolers may have a number of fittings used to couple with tubes and/or pipes for coolant and gas exchange.

However, the inventors herein have recognized potential issues with such systems. As one example, the fittings of an EGR cooler are often subjected to intense temperatures and involve extended contact with fluids. As a consequence, the materials used to construct fittings to fulfill these requirements are often exotic and/or expensive. In addition, the assembly and repair of the fittings can also be time-consuming and increase labors costs. EGR cooler fittings may develop leaks and because the coolers are often located near several high-temperature areas of the engine (such as the cylinder head and exhaust manifold) a leak in the fittings can result in engine degradation. The coolers and their connections also tend to be bulky and increase the overall volume occupied within the engine compartment.

In one example, the issues described above may be addressed by an exhaust gas recirculation (EGR) system, comprising: an EGR cooler module including a body and an EGR inlet port, EGR outlet port, and coolant inlet port, all extending from the body and arranged in parallel with one another and at a same, first side of a cylinder head, where the EGR inlet port and coolant inlet port are directly coupled to the first side of the cylinder head. In this way, the EGR cooler module may interface directly with coolant and gas passages within the cylinder head. In one example, the bolts that mount the EGR cooler module to the surface of the cylinder head also compress a gasket that seals the connection between the surfaces. The result is that the EGR cooler module has a compact form with fewer fittings.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIG. 2 and FIGS. 4-6 are shown approximately to scale.

DETAILED DESCRIPTION

Figure 1:
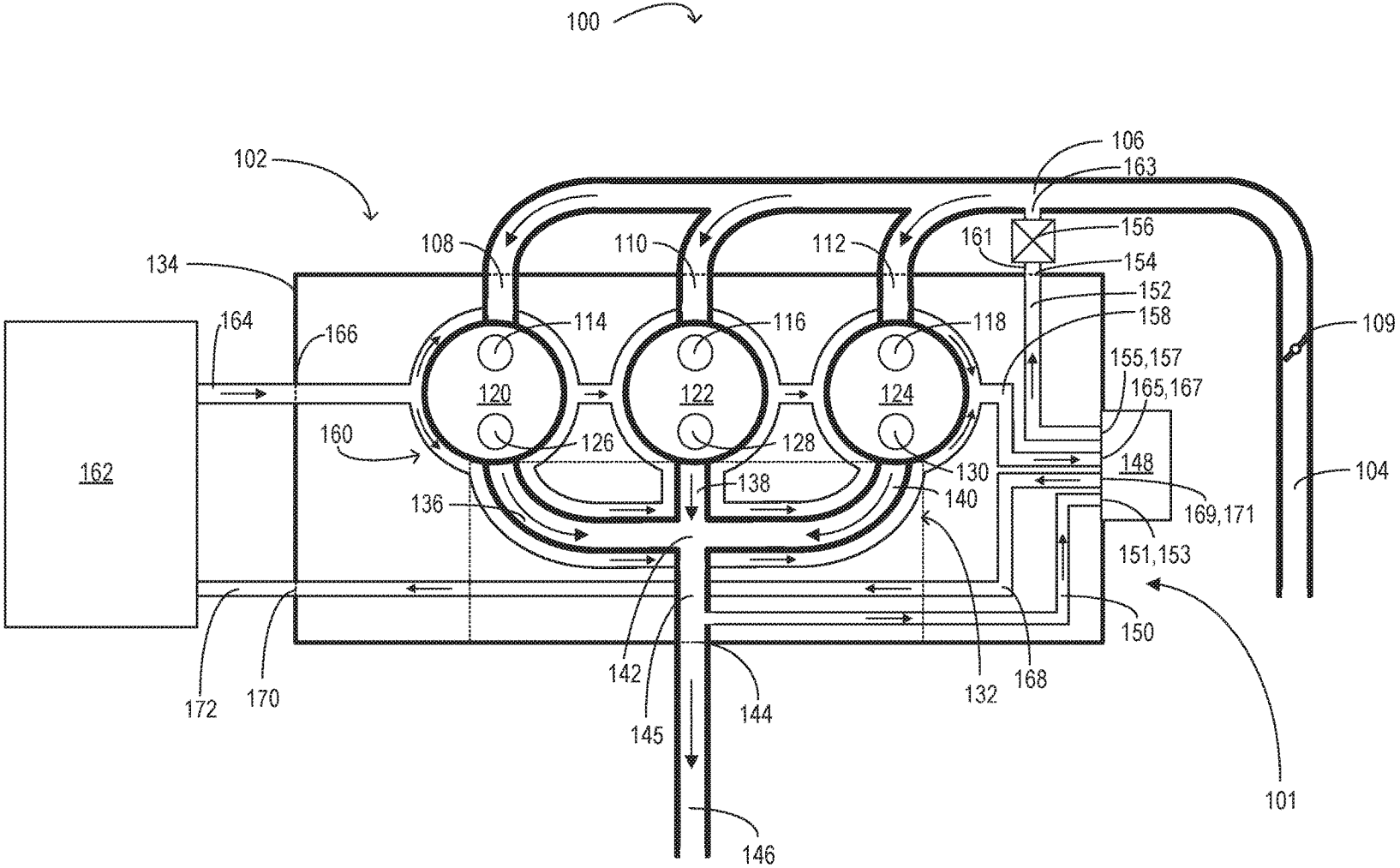
FIG. 1 shows a schematic of a first embodiment of an engine system including an EGR system with an EGR cooler module mounted to a cylinder head.
Figure 2:
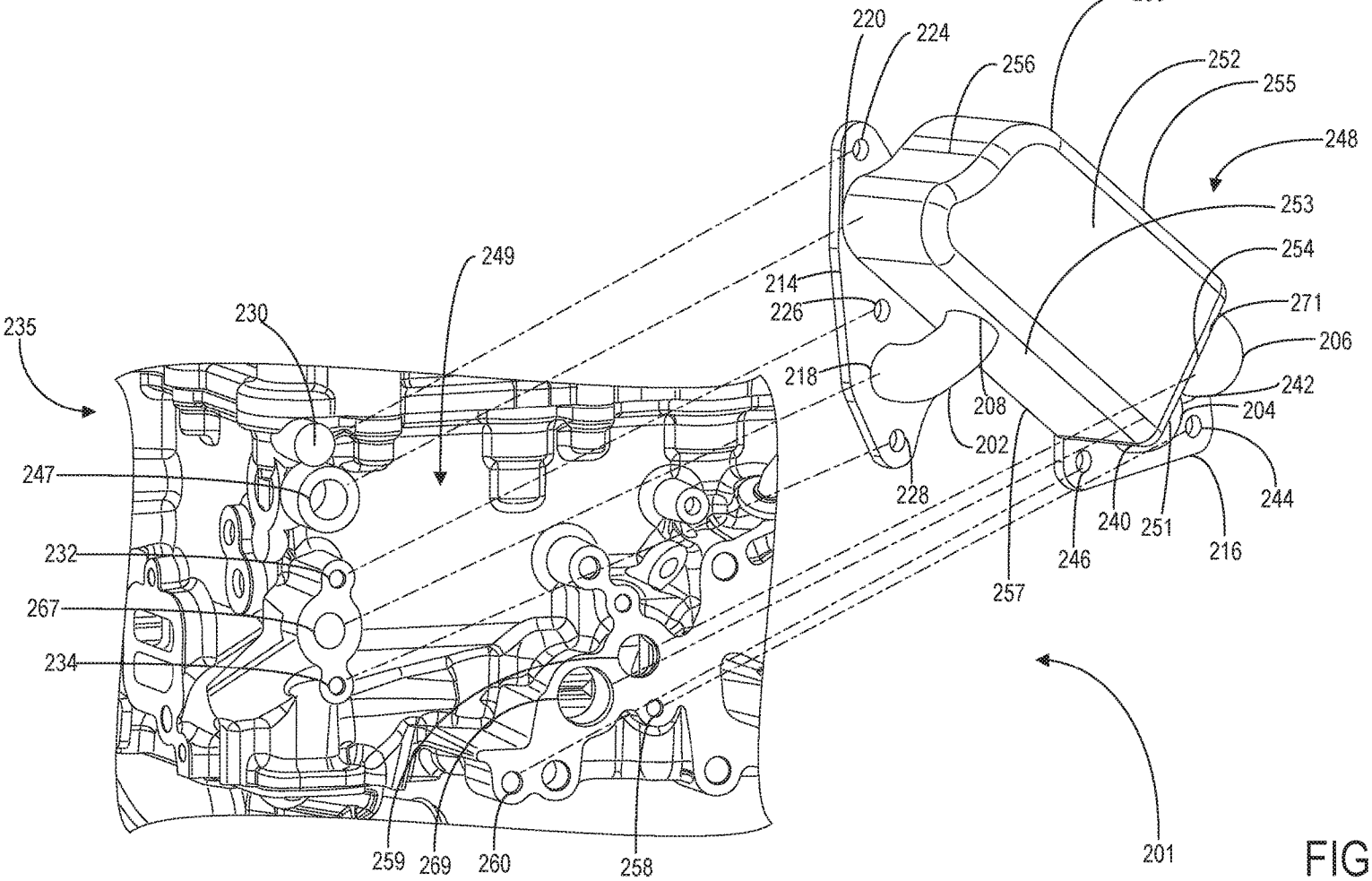
FIG. 2 shows an exploded view of a first embodiment of an EGR system including a cylinder head and EGR cooler module mounted to the cylinder head.

The following description relates to systems and methods for an exhaust gas recirculation (EGR) system including an EGR cooler module directly mounted to a cylinder head. An EGR system of an engine system may include a cylinder head, an EGR cooler module mounted to the cylinder head, and a plurality of coolant and gas passages internal to the cylinder head, as shown in FIG. 1. The cylinder head of the EGR system may include a plurality of mounting surfaces configured such that the EGR cooler module may be directly coupled to the cylinder head, as shown by FIG. 2 and FIGS. 5-6. The cylinder head may include a plurality of coolant ports and gas ports formed by the internal passages of the cylinder head, as shown by FIGS. 1-6. The EGR cooler module may include a plurality of gas ports and coolant ports configured to interface directly with the corresponding ports of the cylinder head when the EGR cooler module is directly coupled to the cylinder head, as shown by FIGS. 1-6. The cylinder head of the EGR system may optionally include additional passages for routing gas and coolant from the EGR cooler module back through the cylinder head, as shown in the embodiment of FIGS. 1-2. The EGR system may optionally include coolant and gas passages external to the cylinder head for the EGR cooler module to return coolant and gas to the engine system, as shown in the embodiment presented at FIGS. 3-6. Additionally, FIG. 7 presents a method for flowing coolant and exhaust gas through a cylinder head and EGR cooler module directly coupled to the cylinder head, such as the cylinder head and EGR cooler module of one of the embodiments shown in FIGS. 1-2 and/or FIGS. 3-6. In this way, the EGR cooler module of the EGR system may interface with the cylinder head to receive coolant and exhaust gas and may return gas and coolant to the engine system via passages internal to the cylinder head or passages external to the cylinder head.

Similar components in FIGS. 1-7 are labeled similarly and may only be explained once below and not re-introduced with reference to each figure.

FIG. 1 shows a schematic including an engine system 100, as well as an EGR system 101. The engine system 100 includes a multi-cylinder internal combustion engine 102. Engine 102 may include a plurality of cylinders (e.g., combustion chambers) which may be capped on the top by cylinder head 134. In the example shown in FIG. 1, engine 102 includes three cylinders: 120, 122, and 124. It will be appreciated that the cylinders may share a single engine block (not shown) and a crankcase (not shown), where engine block is coupled to and below the cylinder head. The engine system 100 also includes an intake manifold 106, an integrated exhaust manifold (IEM) 132, and a radiator 162.

FIG. 1 is a schematic view showing the flow of gas and coolant between components of the engine system 100. Therefore, the passages and components are not shown to scale and the relative positioning, size, and number of passages may vary in physical embodiments (e.g., the embodiment shown by FIG. 2).

While engine 102 is depicted as an inline-three engine with three cylinders, it will be appreciated that other embodiments may include a different number of cylinders and arrangement of cylinders, such as V-6, I-4, I-6, V-12, opposed 4, and other engine types.

Each cylinder may receive intake air from intake manifold 106 via intake passage 104. Intake manifold 106 may contain cylinder intake passages (e.g., runners) 108, 110, and 112 coupled to the cylinders via intake ports 114, 116, and 118, respectively. Each intake port may supply air and/or fuel to the cylinder it is coupled to for combustion. Each intake port can selectively communicate with the cylinder via one or more intake valves. Cylinders 120, 122, and 124 are shown in FIG. 1 with one intake port each, with each intake port including an intake valve disposed within. For example, cylinder 120 has one intake port 114, cylinder 122 has one intake port 116, and cylinder 124 has one intake port 118. Other embodiments may include a different number of intake ports and/or intake valves per cylinder (e.g., two, three, etc.).

Each cylinder (e.g., cylinders 120, 122, and 124) may receive fuel from fuel injectors (not shown) coupled directly to the cylinder, as direct injectors, and/or from injectors coupled to the intake manifold 106, as port injectors. Further, air charges within each cylinder may be ignited via spark from respective spark plugs (not shown). In other embodiments, the cylinders of engine 102 may be operated in a compression ignition mode, with or without an ignition spark.

Intake passage 104 may include an air intake throttle 109. The position of throttle 109 can be adjusted via a throttle actuator (not shown) communicatively coupled to a controller (not shown). By modulating air intake throttle 109, an amount of fresh air may be inducted from the atmosphere into engine 102, delivered to the engine cylinders via intake manifold 106. A portion of the intake air may be compressed by a compressor (not shown) and/or cooled by a charge air cooler (not shown).

Each cylinder may exhaust combustion gases via one or more exhaust valves into exhaust ports (e.g., cylinder exhaust ports) coupled thereto. Cylinders 120, 122, and 124 are shown in FIG. 1 with one exhaust port each, each including an exhaust valve disposed therein for exhausting combustion gases from a corresponding cylinder. For example, cylinder 120 has one exhaust port 126, cylinder 122 has one exhaust port 128, and cylinder 124 has one exhaust port 130. Other embodiments may include a different number of exhaust ports and/or exhaust valves per cylinder (e.g., two, three, etc.).

Each cylinder may be coupled to a manifold exhaust port 144 for exhausting combustion gases. In the example of FIG. 1, an internal exhaust junction 142 internal to the IEM 132 receives exhaust gases from cylinder 120 via exhaust port 126 coupled to runner (e.g., exhaust runner) 136, exhaust gases from cylinder 122 via exhaust port 128 coupled to runner 138, and exhaust gases from cylinder 124 via exhaust port 130 coupled to runner 140. Exhaust gases entering the internal exhaust junction 142 may mix and converge. Exhaust gases travel from the internal exhaust junction 142 through manifold exhaust passage 145 to the manifold exhaust port 144. Therefrom, the exhaust gases are directed via an external exhaust passage 146 (external to the IEM 132 and cylinder head 134) to other engine components (such as an emission control device and/or turbine of a turbocharger, not shown). It will be noted that in the example of FIG. 1, the runners 136, 138, and 140, as well as the internal exhaust junction 142, manifold exhaust passage 145, and manifold exhaust port 144, are integrated within the cylinder head 134 collectively as the integrated exhaust manifold (IEM) 132. In other words, the components of the IEM 132 are internal to the cylinder head 134. Alternate embodiments may contain a different number and/or arrangement of runners, manifold exhaust ports, internal exhaust junctions, and/or internal exhaust passages.

As described above, each cylinder comprises one intake valve (disposed within an intake port) and one exhaust valve (disposed within an exhaust port). Herein, each intake valve is actuatable between an open position allowing intake air into a respective cylinder and a closed position substantially blocking intake air from the respective cylinder. Intake valves within intake ports 114, 116, and 118 are actuated by a common intake camshaft (not shown). The intake camshaft includes a plurality of intake cams (not shown) configured to control the opening and closing of the intake valves. Each intake valve may be controlled by one or more intake cams, which will be described further below. In some embodiments, one or more additional intake cams may be included to control the intake valves. Further still, intake actuator systems may enable the control of intake valves.

Each exhaust valve is actuatable between an open position allowing exhaust gas out of a respective cylinder and a closed position substantially retaining gas within the respective cylinder. Exhaust valves within exhaust ports 126, 128, and 130 are actuated by a common exhaust camshaft (not shown). Exhaust camshaft includes a plurality of exhaust cams (not shown) configured to control the opening and closing of the exhaust valves. Each exhaust valve may be controlled by one or more exhaust cams, which will be described further below. In some embodiments, one or more additional exhaust cams may be included to control the exhaust valves. Further, exhaust actuator systems may enable the control of exhaust valves.

Intake valve actuator systems and exhaust valve actuator systems may further include push rods, rocker arms, tappets, etc. (not shown). Such devices and features may control actuation of the intake valves and the exhaust valves by converting rotational motion of the cams into translational motion of the valves. In other examples, the valves can be actuated via additional cam lobe profiles on the camshafts, where the cam lobe profiles between the different valves may provide varying cam lift height, cam duration, and/or cam timing. However, alternative camshaft (overhead and/or pushrod) arrangements could be used, if desired. Further, in some examples, cylinders 120, 122, and 124 may each have more than one exhaust valve and/or intake valve. In still other examples, exhaust valves and intake valves may be actuated by a common camshaft. However, in alternate embodiments, at least one of the intake valves and/or exhaust valves may be actuated by its own independent camshaft or other device.

Surrounding the cylinders 120, 122, and 124, as well as the IEM 132 and its components (e.g., runners, junctions, etc.) within the cylinder head 134 are a plurality of coolant passages 160. The coolant passages 160 are connected to one or more coolant inlet and outlet ports (e.g., such as first engine coolant inlet port 166, first engine coolant outlet port 167, second engine coolant inlet port 169, and second engine coolant outlet port 170) to facilitate the circulation of coolant throughout the cylinder head 134 and around the IEM 132.

Upon entering the cylinder head 134 through a coolant inlet (e.g., first engine coolant inlet port 166) the coolant passes through the plurality of coolant passages (e.g., coolant passages 160) within the cylinder head 134 and receives heat from the components of the cylinder head 134 and IEM 132. The coolant exits the cylinder head 134 through one or more coolant outlets (e.g., first engine coolant outlet port 167). The coolant then passes through an EGR cooler module 148 directly coupled to a side of the cylinder head 134, returns to the cylinder head 134 through a second coolant inlet port (e.g., second engine coolant inlet port 169), exits the cylinder head 134 again through a second coolant outlet port (e.g., second engine coolant outlet port 170) and enters the radiator 162 in order to reduce its thermal energy before re-entering the cylinder head 134 at the first inlet port (e.g., first engine coolant inlet port 166). In the embodiment of FIG. 1, second engine coolant outlet port 170 is coupled to the radiator 162 via second external coolant passage 172. The radiator 162 is also coupled to first engine coolant inlet port 166 of the cylinder head 134 via first external coolant passage 164. The radiator 162 is utilized to reduce the thermal energy of the coolant. In alternate embodiments the radiator 162 may be coupled to additional devices (e.g., fans) to remove thermal energy from the coolant. It may also optionally or additionally circulate coolant through one or more additional devices (e.g., pumps).

The EGR cooler module 148 is directly coupled (e.g., directly mounted without any intervening components separating the EGR cooler module and cylinder head) to the cylinder head 134 through the use of bolts or other mechanical fixation elements (as described in the discussion of FIG. 2 below). The EGR cooler module 148 contains a plurality of ports at an exterior of the EGR cooler module 148, with each port capable of fluidic communication with a corresponding port on an exterior of the cylinder head (as shown by FIG. 2).

A first internal passage 150 of the cylinder head 134 is internal to the cylinder head 134 and routes exhaust gas through the cylinder head 134. In the schematic of FIG. 1, the first internal passage 150 is in fluidic communication with manifold exhaust passage 145 downstream of internal exhaust junction 142 where exhaust from all of the cylinders converges (e.g., cylinders 120, 122, 124). The first internal passage 150 is a peripheral passage to manifold exhaust passage 145. In other words, first internal passage 150 receives a portion of the exhaust gases flowing through manifold exhaust passage 145. In alternate embodiments, the first internal passage 150 may receive exhaust gases from upstream of internal exhaust junction 142 and may be a peripheral passage (as described above) to one or more exhaust runners (such as exhaust runners 136, 138, and 140) of one or more cylinders (such as cylinders 120, 122, and 124). In these alternate embodiments, the first internal passage 150 may receive a portion of exhaust gases from one or more runners of one or more cylinders but it does not receive exhaust gases downstream of a junction at which exhaust from all of the cylinders converges (e.g., internal exhaust junction 142). In this way, the first internal passage 150 may receive exhaust gases expelled from one or more cylinders of the engine.

The first internal passage 150 routes exhaust gases through the cylinder head 134 from the manifold exhaust passage 145 (which may be referred to herein as an exhaust manifold) to a first engine EGR outlet port 151. The first engine EGR outlet port 151 is in fluidic communication with an EGR inlet port 153 of the cooler module 148 (as described in the discussion of FIG. 2 below). The EGR inlet port 153 may hereafter be referred to as module EGR inlet port 153. From the module EGR inlet port 153, exhaust gas is routed through and cooled by the EGR cooler module 148. Cooled exhaust gases from the EGR cooler may then exit the EGR cooler via an EGR outlet port (e.g., module EGR outlet port) 157. A second internal passage 152 of the cylinder head 134 is internal to the cylinder head 134 and routes cooled exhaust gases from a first engine EGR inlet port 155 to a second engine EGR outlet port 154. The first engine EGR inlet port 155 is in fluidic communication with the EGR outlet port 157 of the EGR cooler module 148.

The second engine EGR outlet port 154 is in fluidic communication with an EGR passage (which may hereafter be referred to as an external EGR passage) 161 arranged external to the cylinder head 134 (e.g., not formed within the cylinder head). An EGR valve 156 is coupled inline with the external EGR passage 161. The external EGR passage 161 is also in fluidic communication with an intake EGR inlet port 163 of the intake manifold 106. The EGR valve 156 may be actuated by an actuator (not shown) to control the flow of gases from the second engine EGR outlet port 154, through the external EGR passage 161, to the intake EGR inlet port 163, and into the intake manifold 106.

In the embodiment of FIG. 1, the intake EGR inlet port 163 is upstream of the cylinder intake passages 108, 110, and 112 within the intake manifold 106. Alternate embodiments may exist in which the intake EGR inlet port is not upstream of all of the cylinder intake passages and may be downstream of one or more of the cylinder intake passages. Alternate embodiments may additionally include a plurality of external EGR passages (similar to external EGR passage 161) coupling the second engine EGR outlet port to one or more intake EGR inlet ports (similar to intake EGR inlet port 163) at the intake manifold and/or one or more cylinder intake passages.

The EGR cooler module 148 contains a plurality of passages (not shown) to facilitate the transfer of heat from the exhaust gas received through the module EGR inlet port 153 to a supply of coolant within the EGR cooler module 148. The passages within the EGR cooler module 148 containing exhaust gases and the passages within the EGR cooler module 148 containing coolant are separated and not in fluidic communication with each other. However, the gas passages and coolant passages are proximate to each other and may be simultaneously proximate to a material with high thermal conductivity (e.g., metal). Heat may transfer from the gas within the exhaust gas passages through a proximate thermally conductive material and into the coolant. In this way, the EGR cooler module 148 cools the gas exiting the module such that the gas entering the module is at a higher temperature than the gas exiting the module.

The coolant within the EGR cooler module 148 is supplied through a coolant inlet port (which may hereafter be referred to as module coolant inlet port) 165 of the EGR cooler module 148. The module coolant inlet port 165 is in fluidic communication with a third internal passage 158 of the cylinder head 134. The third internal passage 158 is internal to the cylinder head 134 and routes through the cylinder head 134.

The third internal passage 158 is in fluidic communication with the plurality of passages 160 internal to the cylinder head 134 that surround the cylinders, runners, and other components internal to the cylinder head 134. These passages 160 are fluidically isolated from the cylinders, runners, and other components that they surround but are not fluidically isolated from each other (e.g., coolant may flow within the coolant passages but does not flow into other components of the cylinder head). In other words, the passages are separated from the cylinders, runners, and other components by interior walls of the cylinder head.

Coolant is routed through the passages from the radiator 162. The radiator 162 is coupled to the first exterior coolant passage 164 which is in fluidic communication with the first engine coolant inlet port 166. The first engine coolant inlet port 166 is coupled to the passages 160 such that coolant flows from the radiator 162, through the first exterior coolant passage 164, through the first engine coolant inlet port 166, and into the plurality of passages 160 within the cylinder head.

The coolant entering the plurality of passages via the radiator 162 is routed through the third internal passage 158 and passes through a first engine coolant outlet port 167. The first engine coolant outlet port 167 is coupled (e.g., directly coupled) to the module coolant inlet port 165 and is in fluidic communication with the plurality of coolant passages (not shown) within the EGR cooler module 148. In this way, the EGR cooler module 148 receives coolant from the radiator 162 via the passages (e.g., passages 160 and third internal passage 158) within the cylinder head 134.

The plurality of coolant passages (not shown) within the EGR cooler module 148 return coolant to a module coolant outlet port 171 which is coupled (e.g., directly coupled) to the second engine coolant inlet port 169. The coolant transfers from the module coolant outlet port 171 into the second engine coolant inlet port 169 and then into a fourth internal passage 168 of the cylinder head 134. The fourth internal passage 168 is internal to (e.g., positioned within an interior of) the cylinder head 134 and formed by the interior walls of the cylinder head 134. The fourth internal passage 168 routes coolant through the cylinder head 134 and to the second engine coolant outlet port 170. The second engine coolant outlet port 170 is coupled to the second external coolant passage 172. The second external coolant passage 172 is external to the cylinder head 134 and is coupled to (and in fluidic communication with) both the radiator and the second engine coolant outlet port 170. In this arrangement, coolant may exit the EGR cooler module 148, flow through the fourth internal passage 168, and enter the radiator 162 via the second external coolant passage 172 coupled to the second engine coolant outlet port 170.

In the schematic of the configuration of the engine system 100 as described above, the EGR cooler module 148 receives coolant via a direct coupling between the first engine coolant outlet port 167 and the module coolant inlet port 165, and receives exhaust gas via a direct coupling between the first engine EGR outlet port 151 and the module EGR inlet port 153. The proximate passages internal to the EGR cooler module 148 then transfer thermal energy away from the exhaust gas and into the coolant. The cooled exhaust gas exits the EGR cooler module 148 and enters the cylinder head 134 via first engine EGR inlet port 155 where it is routed through second internal passage 152 to the second engine EGR outlet port 154. The flow of the cooled gas through external EGR passage 161 into the intake EGR inlet port 163 of the intake manifold 106 is controlled by the actuation of EGR valve 156.

The coolant exits the EGR cooler module 148 through the module coolant outlet port 171 and enters the fourth internal passage 168 of the cylinder head 134 via a direct coupling between the module coolant outlet port 171 and the second engine coolant inlet port 169. The coolant flows out of the fourth internal passage 168 via the second engine coolant outlet port 170 and into the second external coolant passage 172 coupled with radiator 162. In this way, the EGR cooler module 148 uses coolant from an internal coolant passage of the cylinder head 134 and exhaust gas from an internal gas passage of the cylinder head to cool exhaust gases from the cylinders (120, 122, and 124). It then routes the cooled gases into the intake manifold via another internal gas passage of the cylinder head and the coolant into the radiator via another internal coolant passage of the cylinder head.

By directly coupling coolant inlets/outlets and EGR inlets/outlets of the EGR cooler module to the corresponding coolant inlets/outlets and EGR inlets/outlets on the cylinder head, the EGR cooler module is able to receive and transmit EGR gas and coolant from the cylinder head without additional fittings.

FIG. 2 shows an exploded view of a first embodiment of an EGR system 201 including an EGR cooler module 248 (e.g., such as the EGR cooler module 148 shown by FIG. 1) directly mounted to a first cylinder head surface 249 of a cylinder head 235 (e.g., such as the cylinder head 134 shown by FIG. 1) in an arrangement similar to the configuration described above during the discussion of FIG. 1. The first cylinder head surface 249 may be on a single, first side of the cylinder head 235. The EGR cooler module 248 includes a housing (e.g., housing body or body) 200, a plurality of rigid pipes (e.g., pipes 202, 204, and 206) and a plurality of flanges (e.g., flanges 214 and 216). The housing 200 contains a plurality of internal cooling tubes (for flowing coolant) and internal gas passages (for flowing exhaust gas) therein. The housing, rigid pipes, and flanges of the EGR cooler module 248 may be constructed of a material (e.g., metal) resistant to wear by corrosion and/or high temperatures associated with engine fluids and gases. The housing, rigid pipes, flanges, and other components of the EGR cooler module may be formed together (e.g., molded) as one piece and/or may be fused together (e.g., welded).

In the example of the embodiment of the EGR cooler module 248 shown in FIG. 2, the housing 200 of the EGR cooler module 248 is formed such that the shape of the EGR cooler module 248 is approximately a rectangular parallelepiped. The housing 200 possesses an outward surface (which may hereafter be referred to as outward module surface) 252 that is parallel to and faces away from the first cylinder head surface 249 of the cylinder head 235 when the EGR cooler module 248 is mounted to the cylinder head 235 (as described below). The outward module surface 252 is joined to a plurality of perpendicular module surfaces (e.g., surfaces 253, 254, 255, and 256) which are arranged perpendicular to the outward module surface 252. The perpendicular module surfaces are joined to an inward module surface 257 (e.g., the surface facing the first cylinder head surface 249) which is arranged parallel to (and opposite from) the outward module surface 252. In the example of the embodiment of the EGR cooler module 248 shown by FIG. 2, the perpendicular module surfaces 253, 254, and 255 are planar (e.g., flat) while the perpendicular module surface 256 possesses a curve in the direction of the interior of the EGR cooler module 248. The inward module surface 257 and outward module surface 252 are both planar (e.g., flat) and the outward module surface 252 is joined to the perpendicular surfaces with rounded edges while the inward module surface 257 is joined to the perpendicular surfaces without rounded edges. Alternate embodiments may exist in which the EGR cooler module possesses additional or fewer curves and/or has additional or fewer surfaces.

The EGR cooler module 248 of FIG. 2 is directly coupled (e.g., formed as one piece or fused together) with three rigid pipes 202, 204, and 206 (which may hereafter be referred to as first module pipe 202, second module pipe 204, and third module pipe 206). A first end (e.g., an end originating from the housing) of the first module pipe 202 is coupled to a housing coolant inlet 208 of the housing 200. A first end (e.g., an end originating from the housing) of the second module pipe 204 is coupled to a housing coolant outlet 251 of the housing 200 and a first end (e.g., an end originating from the housing) of the third module pipe 206 is coupled to a housing EGR outlet 271 of the housing 200.

The rigid pipes 202, 204, and 206, and the housing coolant inlet 208, housing coolant outlet 251, and housing EGR outlet 271 in the example of the embodiment shown in FIG. 2 are arranged such that the inlets/outlets (208, 251, and 271) and first ends (as described above) of the pipes (202, 204, and 206) are positioned along the plurality of perpendicular module surfaces. The housing coolant inlet 208 (and the first end of the first module pipe 202) is positioned along the perpendicular module surface 253 (which may hereafter be referred to as first module perpendicular surface 253). The housing coolant outlet 251 and the housing EGR outlet 271 (as well as the first end of the second module pipe 204 and the first end of the third module pipe 206) are positioned along the perpendicular surface 254 (which may hereafter be referred to as second module perpendicular surface 254).

The flange 214 (which may be referred to as first module flange 214) is arranged parallel to the inward and outward module surfaces (257 and 252 respectively) and is joined with (e.g., formed from and/or welded to) the inward module surface 257. The first module flange 214 projects outward from the housing 200 of the EGR cooler module 248 away from the perpendicular module surfaces 253 and 256. Similarly, the flange 216 (which may be referred to as second module flange 216) is arranged parallel to the inward and outward module surfaces (257 and 252 respectively) and is joined with (e.g., formed from and/or welded to) the inward module surface 257. The second module flange 216 projects outward from the housing 200 of the EGR cooler module 248 away from the perpendicular module surface 254. Because the first module flange 214 and the second module flange 216 are simultaneously parallel to the inward and outward module surfaces (257 and 252 respectively), the first module flange 214 and the second module flange 216 are also parallel to each other. The first module flange 214 and second module flange 216 are also parallel to the first cylinder head surface 249 (and first side of the cylinder head).

The first module flange 214 includes a module coolant inlet port 218 (e.g., such as the module coolant inlet port 165 shown by FIG. 1) coupled with a second end (e.g., an end not originating from the housing) of the first module pipe 202. The module coolant inlet port 218 is in face-sharing contact with (and in fluidic communication with) a first engine coolant outlet port 267 (e.g., such as the first engine coolant outlet port 167 shown by FIG. 1) on the first cylinder head surface 249 of the cylinder head. The first module flange 214 also includes a module EGR inlet port 220 (e.g., such as the module EGR inlet port 153 shown by FIG. 1) in face-sharing contact with (and in fluidic communication with) a first engine EGR outlet port 247 (e.g., such as the first engine EGR outlet port 151 shown by FIG. 1) on the first cylinder head surface 249 of the cylinder head. In this arrangement, the module coolant inlet port 218 facilitates the flow of coolant from the first engine coolant outlet port 267 into EGR cooler module 248 via the first module pipe 202 coupled with the housing coolant inlet 208. The module EGR inlet port 220 facilitates the flow of EGR gas from the first engine EGR outlet port 247 directly into the EGR cooler module 248 via face-sharing contact between the module EGR inlet port 220 and the first engine EGR outlet port 247 (without the use of a rigid pipe).

The first module flange 214 also includes a plurality of eyelets (e.g., eyelets 224, 226, and 228) sized and shaped to accommodate bolts. In the example of the embodiment of the first module flange 214 shown by FIG. 2, the first module flange 214 has three eyelets 224, 226, and 228. Alternate embodiments may exist in which the first module flange has a different number of eyelets (e.g., four, five, etc.). The eyelets are configured on the first module flange 214 in an arrangement that matches the arrangement of a plurality of mounting surfaces on the first cylinder head surface 249. The eyelets 224, 226, and 228 of the first module flange 214 in the embodiment shown in FIG. 2 are configured to align with three mounting surfaces 230, 232, and 234 when the first module flange 214 is placed flush against the mounting surfaces. The mounting surfaces 230, 232, and 234 are formed such that they may accept the threaded ends of the bolts passing through eyelets 224, 226, and 228, thereby directly mounting the first module flange 214 to the first side of the cylinder head 235 and first cylinder head surface 249.

The module coolant inlet port 218 and the module EGR inlet port 220 are arranged on the first module flange 214 such that when the first module flange 214 is bolted to the mounting surfaces 230, 232, and 234 of the cylinder head 235, the module coolant inlet port 218 is in face-sharing contact with the first engine coolant outlet port 267 and the module EGR inlet port 220 is in face-sharing contact with the first engine EGR outlet port 247. One or more gaskets (not shown) may be secured between the first module flange 214 and the mounting surfaces (230, 232, and 234) of the cylinder head 235 such that the gasket(s) permit fluidic communication without leakage between the module coolant inlet port 218 and the first engine coolant outlet port 267 as well as fluidic communication without leakage between the module EGR inlet port 220 and the first engine EGR outlet port 247. The gasket(s) do not allow fluidic communication between the module coolant inlet port 218 and the module EGR inlet port 220. The gasket(s) are formed from a material suitable for contact with corrosive and/or high-temperature fluids from the cylinder head 235 (e.g., a rubber-like material).

The second module flange 216 includes a module coolant outlet port 240 (e.g., such as module coolant outlet port 171 shown by FIG. 1) coupled with a second end (e.g., an end not originating from the housing) of the second module pipe 204. The module coolant outlet port 240 is in face-sharing contact with (and in fluidic communication with) a second engine coolant inlet port 269 (e.g., such as the second engine coolant inlet port 169 shown by FIG. 1). The second module flange 216 also includes a module EGR outlet port 242 (e.g., such as module EGR outlet port 157 shown by FIG. 1) coupled with a second end (e.g., an end not originating from the housing) of the third module pipe 206. The module EGR outlet port 242 is in face-sharing contact with (and in fluidic communication with) a first engine EGR inlet port 259 (e.g., such as the first engine EGR inlet port 155 shown by FIG. 1). In this arrangement, the module coolant outlet port 240 facilitates the flow of coolant from the EGR cooler module 248, via the second module pipe 204 coupled with the housing coolant outlet 251, and into the second engine coolant inlet port 269 of the cylinder head 235. The module EGR outlet port 242 facilitates the flow of EGR gas from the EGR cooler module 248, via the third module pipe 206 coupled with the housing EGR outlet 271, and into the first engine EGR inlet port 259 of the cylinder head 235.

The second module flange 216 also includes a plurality of eyelets (e.g., eyelets 244 and 246) sized and shaped to accommodate bolts. In the example of the embodiment of the first module flange 214 shown by FIG. 2, the second module flange 216 has two eyelets 244 and 246. Alternate embodiments may exist in which the first module flange has a different number of eyelets (e.g., three, four, etc.). The eyelets are configured on the second module flange 216 in an arrangement that matches the arrangement of a plurality of mounting surfaces on the first cylinder head surface 249. The eyelets 244 and 246 of the second module flange 216 in the embodiment shown in FIG. 2 are configured to align with two mounting surfaces 258 and 260 when the second module flange 216 is placed flush against the mounting surfaces. The mounting surfaces 258 and 260 are formed such that they may accept the threaded ends of the bolts passing through eyelets 244 and 246.

The module coolant outlet port 240 and the module EGR outlet port 242 are arranged on the second module flange 216 such that when the second module flange 216 is bolted to the mounting surfaces 258 and 260 of the cylinder head 235, the module coolant outlet port 240 is in face-sharing contact with the second engine coolant inlet port 269 and the module EGR outlet port 242 is in face-sharing contact with the first engine EGR inlet port 259. One or more gaskets (not shown) may be secured between the second module flange 216 and the mounting surfaces (258 and 260) of the cylinder head 235 such that the gasket(s) permit fluidic communication without leakage between the module coolant outlet port 240 and the second engine coolant inlet port 269, as well as fluidic communication without leakage between the module EGR outlet port 242 and the first engine EGR inlet port 259. The gasket(s) do not allow fluidic communication between the module coolant outlet port 240 and the module EGR outlet port 242. The gasket(s) are formed from a material suitable for contact with corrosive and/or high-temperature fluids from the cylinder head 235 (e.g., a rubber-like material).

An alternate embodiment of the EGR cooler module 248 may include a single gasket spanning both the first and second flanges and providing all of the fluidic communications (and isolations) described above.

As described in the discussion of FIG. 1, the first engine EGR outlet port 247 is directly coupled to (e.g., formed by) a first internal passage (e.g., such as first internal passage 150 shown by FIG. 1) of the cylinder head 235, the first engine EGR inlet port 259 is directly coupled to (e.g., formed by) a second internal passage (e.g., such as second internal passage 152 shown by FIG. 1) of the cylinder head 235, the first engine coolant outlet port 267 is directly coupled to (e.g., formed by) a third internal passage (e.g., such as third internal passage 158 shown by FIG. 1) of the cylinder head 235, and the second engine coolant inlet port 269 is directly coupled to (e.g., formed by) a fourth internal passage (e.g., such as fourth internal passage 168 shown by FIG. 1) of the cylinder head 235.

By configuring the EGR cooler module 248 and cylinder head 235 in this way, the EGR cooler module 248 is able to receive coolant from the first engine coolant outlet port 267 of the cylinder head 235 via the module coolant inlet port 218 of the first module flange 214. The coolant flows out of the first engine coolant outlet port 267 of the cylinder head 235 and through the module coolant inlet port 218 of the first module flange 214 into the first module pipe 202. The first module pipe 202 then directs the flow of coolant towards the housing coolant inlet 208 of the EGR cooler module 248. The EGR cooler module 248 is able to return coolant to the second engine coolant inlet port 269 of the cylinder head 235 via the module coolant outlet port 240 of the second module flange 216. The coolant flows from the housing coolant outlet 251 and through the second module pipe 204. The second module pipe 204 then directs the flow of coolant towards the module coolant outlet port 240 of the second module flange 216 directly coupled with the second engine coolant inlet port 269.

The EGR cooler module 248 using this configuration is also able to receive exhaust gases from the first engine EGR outlet port 247 of the cylinder head 235 via the module EGR inlet port 220 of the first module flange 214. The exhaust gas flows out of the first engine EGR outlet port 247 of the cylinder head 235 and through module EGR inlet port 220 (directly coupled to the first engine EGR outlet port 247) of the first module flange 214 into the EGR cooler module 248. Additionally, the EGR cooler module 248 is able to return cooled exhaust gas to the first engine EGR inlet port 259 of the cylinder head 235 via the module EGR outlet port 242 of the second module flange 216. The cooled exhaust gas flows out of the housing EGR outlet 271 and through the third module pipe 206. The third module pipe 206 then directs the flow of cooled exhaust gas towards the module EGR outlet port 242 of the second module flange 216 directly coupled to the first engine EGR inlet port 259.

In this configuration, the flanges of the EGR cooler module may be bolted to the first cylinder head surface 249 of the cylinder head 235 so that the inlet/outlet ports (e.g., ports 218, 220, 240, and 242) of the EGR cooler module 248 are in face-sharing contact with the corresponding ports (e.g., 267, 247, 269, and 259) of the cylinder head 235. This eliminates the use of extra fittings and/or passages for routing fluids to/from the EGR cooler module 248 and achieves a compact form for the EGR cooler module 248. For example, the embodiment of the EGR cooler module shown by FIG. 2 includes four input/output ports (e.g., two input ports and two output ports) directly coupled to corresponding engine ports on the same side of the cylinder head to facilitate the transfer of coolant and EGR gases to/from the EGR cooler module. All four ports are parallel to the same side of the cylinder head and all four are arranged in a common plane. Additionally, all four ports are in face-sharing contact with (and are shaped to couple with) their corresponding ports on the cylinder head (e.g., the engine coolant outlet port is in face-sharing contact with the module coolant inlet port, the engine EGR outlet port is in face-sharing contact with the module EGR inlet port, etc.).

Figure 3:
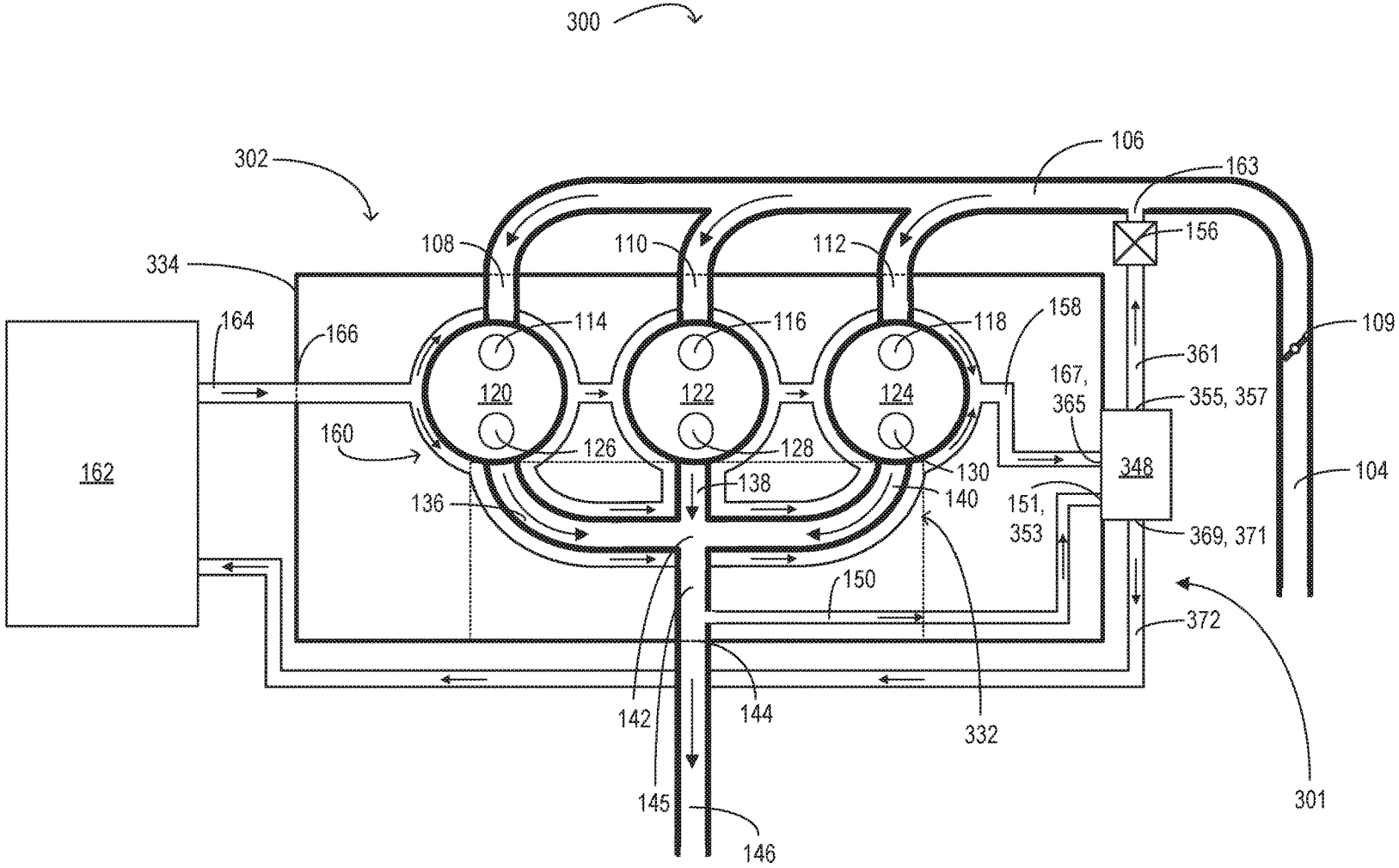
FIG. 3 shows a schematic of a second embodiment of an engine system including an EGR system with an EGR cooler module mounted to a cylinder head.

FIG. 3 depicts a schematic including a second embodiment of an engine system 300 as well as including an EGR system 301. Engine system 300 shown by FIG. 3 includes an engine 302, a cylinder head 334, and an integrated exhaust manifold (IEM) 332. Many of the components included in engine system 300 are also included in engine system 100 of FIG. 1 and are labeled similarly in FIG. 3 and may not be re-introduced. The passages and components shown by FIG. 3 are not shown to scale and the relative positioning, size, and number of passages may vary between physical embodiments (e.g., such as the embodiment shown by FIGS. 4-6).

The embodiment of the engine system 300 of FIG. 3 includes an EGR cooler module 348 directly coupled to a single side of the cylinder head 334. The EGR cooler module 348 possesses a module coolant inlet port 365, a module coolant outlet port 371, a module EGR inlet port 353, and a module EGR outlet port 357.

The engine system 300 shown by FIG. 3 includes three cylinders 120, 122, and 124 with respective intake ports 114, 116, and 118 and exhaust ports 126, 128, and 130. The engine system 300 also includes the exhaust runners 136, 138, and 140 coupled to cylinders 120, 122, and 124 respectively. The exhaust runners merge at internal exhaust junction 142 which routes through manifold exhaust passage 145 to manifold exhaust port 144. Manifold exhaust port 144 is fluidically coupled with external exhaust passage 146, as described by the discussion of FIG. 1 above. The engine system 300 also includes intake passage 104, throttle 109, intake manifold 106, and cylinder intake passages 108, 110, and 112 for the intake of combustible gases. The internal passage 150 (e.g., the first internal passage 150 shown by FIG. 1) is a peripheral exhaust passage downstream of internal exhaust junction 142 (and is internal to the cylinder head 334) and is fluidically coupled to both manifold exhaust passage 145 and the first engine EGR outlet port 151 (as described by the discussion of FIG. 1 above).

The internal passage 150 (e.g., internal to the cylinder head 334 and routing through the cylinder head 334) receives a portion of the exhaust gases flowing through manifold exhaust passage 145 (as described in the discussion of FIG. 1). In alternate embodiments, the first internal passage 150 may be positioned upstream of internal exhaust junction 142 and may be a peripheral passage (as described above) to one or more exhaust runners (such as exhaust runners 136, 138, and 140) of one or more cylinders (such as cylinders 120, 122, and 124). In these alternate embodiments, the first internal passage 150 may receive a portion of exhaust gases from one or more runners of one or more cylinders but it does not receive exhaust gases downstream of a junction at which exhaust from all of the cylinders converges (e.g., internal exhaust junction 142).

The internal passage 150 routes gases through the cylinder head 334 from the manifold exhaust passage 145 to the first engine EGR outlet port 151. The first engine EGR outlet port 151 is in fluidic communication with the module EGR inlet port 353 of the EGR cooler module 348 (as described in the discussion of FIGS. 4-6 below). The module EGR outlet port 357 of the EGR cooler module 348 is in fluidic communication with an external EGR passage 361 (e.g., external to both the cylinder head 334 and the EGR cooler module 348) via an EGR inlet port 355 of the external EGR passage 361. An EGR valve 156 is coupled inline with the external EGR passage 361. The external EGR passage 361 is also in fluidic communication with the intake EGR inlet port 163 of the intake manifold 106. The EGR valve 156 may be actuated by an actuator (not shown) to control the flow of gases from the module EGR outlet port 357 of the EGR cooler module 348, through the external EGR passage 361, to the intake EGR inlet port 163, and into the intake manifold 106.

In the embodiment of FIG. 3, the intake EGR inlet port 163 is upstream of the cylinder intake passages 108, 110, and 112 within the intake manifold 106. Alternate embodiments may exist in which the intake EGR inlet port is not upstream of all of the cylinder intake passages and may be downstream of one or more of the cylinder intake passages. Alternate embodiments may additionally include a plurality of external EGR passages (similar to external EGR passage 361) coupling the module EGR outlet port 357 to one or more intake EGR inlet ports (similar to intake EGR inlet port 163) at the intake manifold and/or one or more cylinder intake passages.

The radiator 162 is coupled to the first engine coolant inlet port 166 via the first external coolant passage 164. The first engine coolant inlet port 166 is fluidically coupled to the plurality of coolant passages 160 internal to the cylinder head 334 and surrounding the components of the cylinder head as described by the discussion of FIG. 1 above. The plurality of coolant passages 160 are fluidically coupled to the internal passage 158 (e.g., the third internal passage 158 shown by FIG. 1) which is fluidically coupled to the first engine coolant outlet port 167.

Similar to the example of EGR cooler module 148 shown by FIG. 1, the EGR cooler module 348 contains a plurality of passages (not shown) to facilitate the transfer of heat from the exhaust gas received through the module EGR inlet port 353 to a supply of coolant within the EGR cooler module 348. The passages within the EGR cooler module 348 containing exhaust gases and the passages within the EGR cooler module 348 containing coolant are separated and not in fluidic communication with each other. However, the gas passages and coolant passages are proximate to each other and may be simultaneously proximate to a material with high thermal conductivity (e.g., metal). Heat may transfer from the gas within the exhaust gas passages through a proximate thermally conductive material and into the coolant. In this way, the EGR cooler module 348 cools the gas exiting the module such that the gas entering the module is at a higher temperature than the gas exiting the module.

The coolant within the EGR cooler module 348 is supplied through the module coolant inlet port 365 of the EGR cooler module 348. The module coolant inlet port 365 is fluidically and directly coupled to the first engine coolant outlet port 167 and receives coolant from the internal passage 158. Coolant is routed through the coolant passages 160 from the radiator 162 and into the internal passage 158 (as described above in the discussion of FIG. 1).

The plurality of coolant passages (not shown) within the EGR cooler module 348 return coolant to the module coolant outlet port 371 which is fluidically coupled to a coolant inlet port 369 of a second external coolant passage 372 (e.g., external to both the cylinder head 334 and the EGR cooler module 348). The coolant transfers from the module coolant outlet port 371 into the second external coolant passage 372 via the coolant inlet port 369. The second external coolant passage 372 is coupled to (and in fluidic communication with) both the radiator 162 and the coolant inlet port 369. In this arrangement, coolant may exit the EGR cooler module 348 through the module coolant outlet port 371 and into the directly coupled coolant inlet port 369. The coolant then flows through the second external coolant passage 372 and enters the radiator 162.

In the configuration of the engine system 300 as described above, the EGR cooler module 348 receives coolant from the first engine coolant outlet port 167 and exhaust gas from the first engine EGR outlet port 151. The proximate passages internal to the EGR cooler module 348 then transfer thermal energy away from the exhaust gas and into the coolant. The cooled exhaust gas exits the EGR cooler module 348 via module EG outlet port 357 and enters the external EGR passage 361 via EGR inlet port 355 where it is routed to the EGR inlet port 163 of the intake manifold 106. The flow of the cooled gas through external EGR passage 361 into the intake manifold 106 is controlled by EGR valve 156.

The coolant exits the EGR cooler module 348 through the module coolant outlet port 371 and enters the second external coolant passage 372 via the coolant inlet port 369 (directly coupled to module coolant outlet port 371). The coolant flows out of the second external coolant passage 372 and into the radiator 162. In this way, the EGR cooler module 348 uses coolant from an internal coolant passage 158 of the cylinder head 334 and exhaust gas from an internal gas passage 150 of the cylinder head to cool exhaust gases from the cylinders (120, 122, and 124). It then routes the cooled gases into the intake manifold 106 via an EGR passage 361 external to the cylinder head 334 and routes the coolant into the radiator 162 via a coolant passage (e.g., second external coolant passage 372) external to the cylinder head 334.

By directly coupling to the surface of the cylinder head and directly interfacing with the coolant outlet and the EGR outlet on the cylinder head, the EGR cooler module is able to receive EGR gas and coolant from the cylinder head without additional fittings, and may transmit coolant and EGR gas to passages external to the cylinder head. For example, the embodiment of the EGR cooler module shown by FIG. 3 includes four module input/output ports (e.g., two input ports and two output ports), with two of the ports directly coupled to corresponding engine ports on a same side of the cylinder head to facilitate the transfer of coolant and EGR gases to the EGR cooler module. Both of the ports directly coupled to the same side of the cylinder head are also parallel to the same side of the cylinder head (e.g., both ports are parallel to a common plane). Additionally, both ports are in face-sharing contact with (and are shaped to couple with) their corresponding ports on the cylinder head (e.g., the engine coolant outlet port is in face-sharing contact with the module coolant inlet port, and the engine EGR outlet port is in face-sharing contact with the module EGR inlet port).

The cylinder head 334 of the engine system 300 of FIG. 3 does not include the second internal passage 152, the fourth internal passage 168, the first engine EGR inlet port 155, the second engine EGR outlet port 154, the second engine coolant inlet port 169, or the second engine coolant outlet port 170. However, alternate embodiments may exist in which one or more or all of these components are included with the cylinder head.

Figure 4:
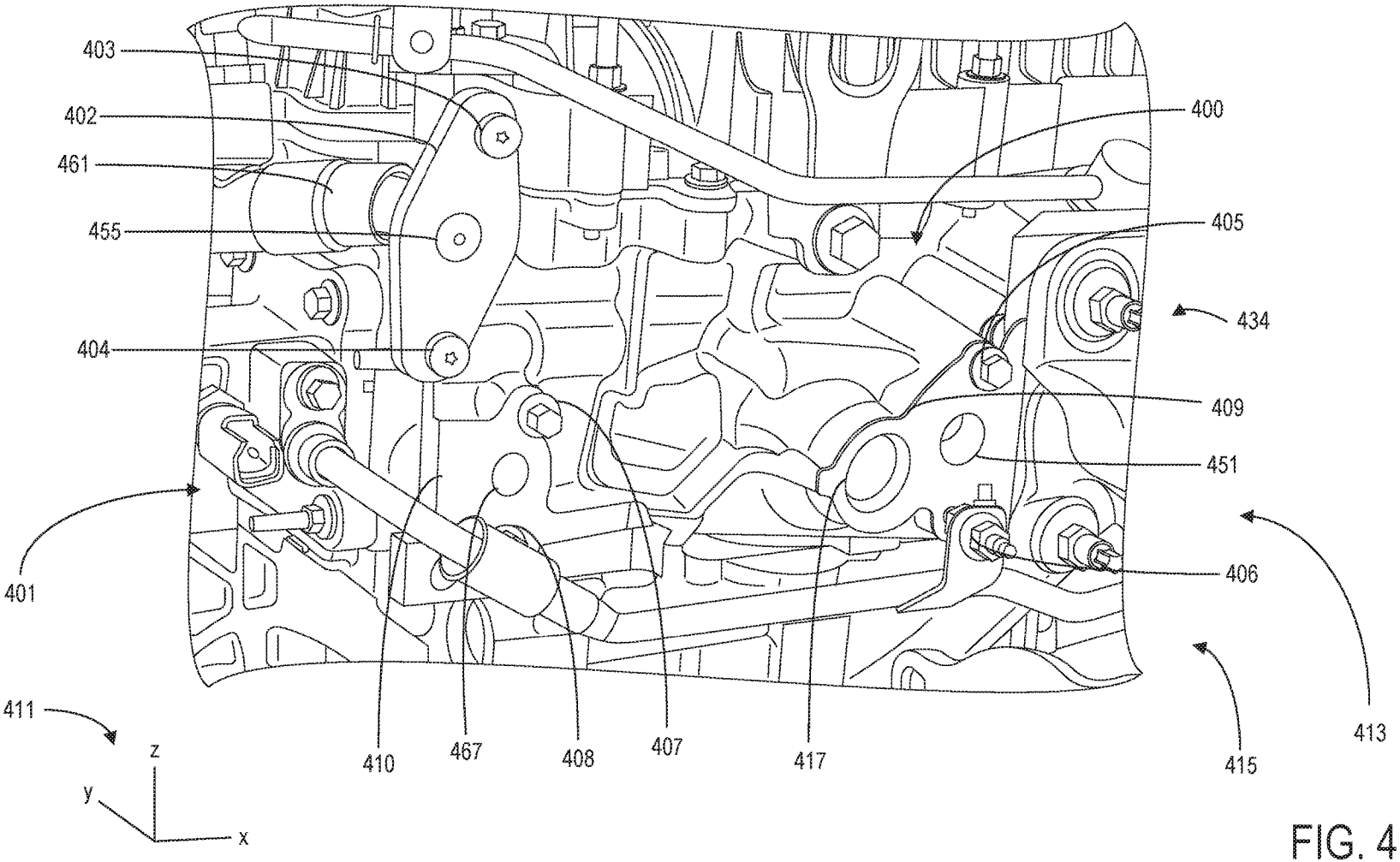
FIG. 4 shows a perspective view of a cylinder head of a second embodiment of an EGR system.
Figure 5:
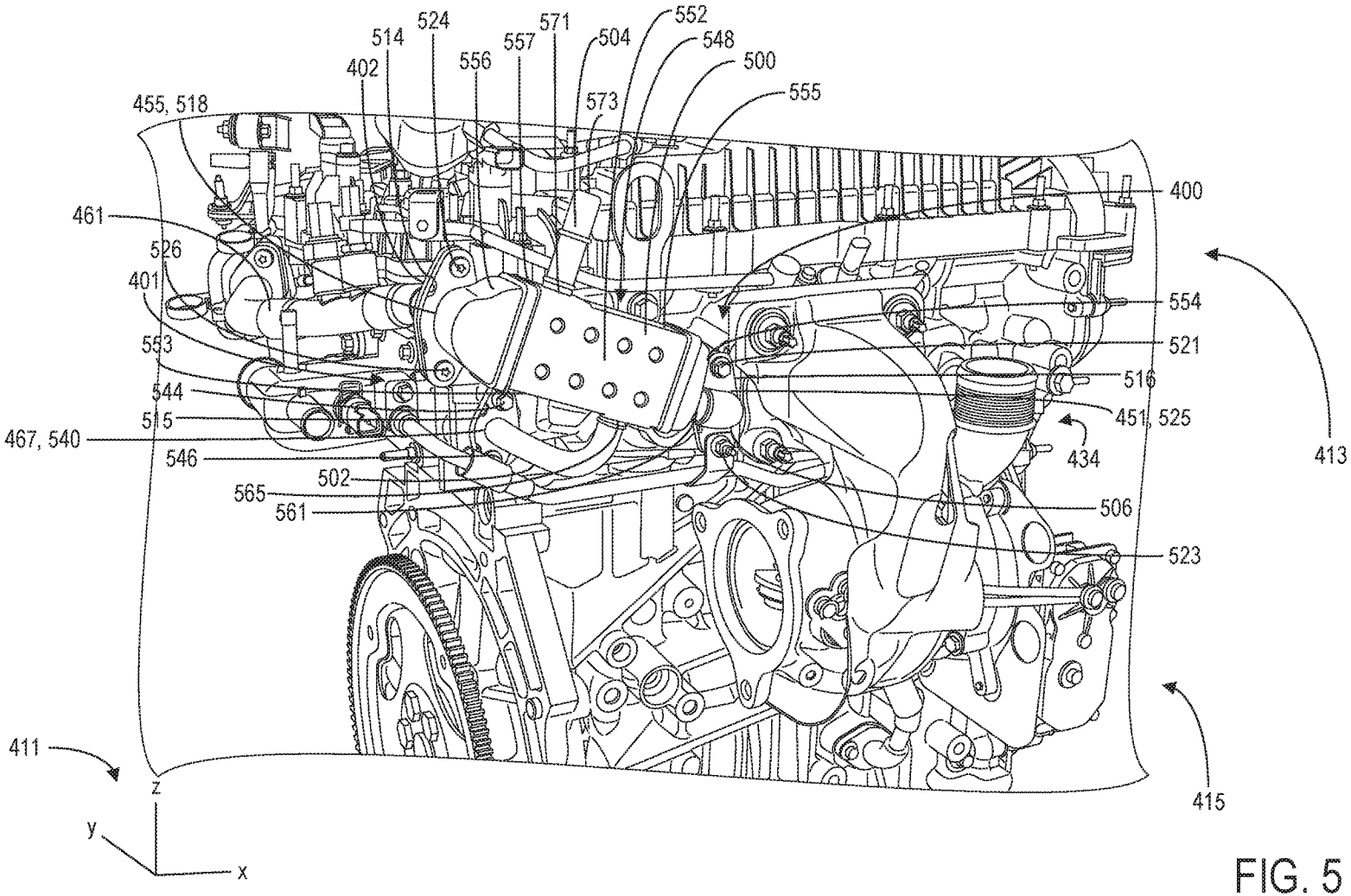
FIG. 5 shows a perspective view of the cylinder head and an EGR cooler module mounted to the cylinder head of the second embodiment of the EGR system.
Figure 6:
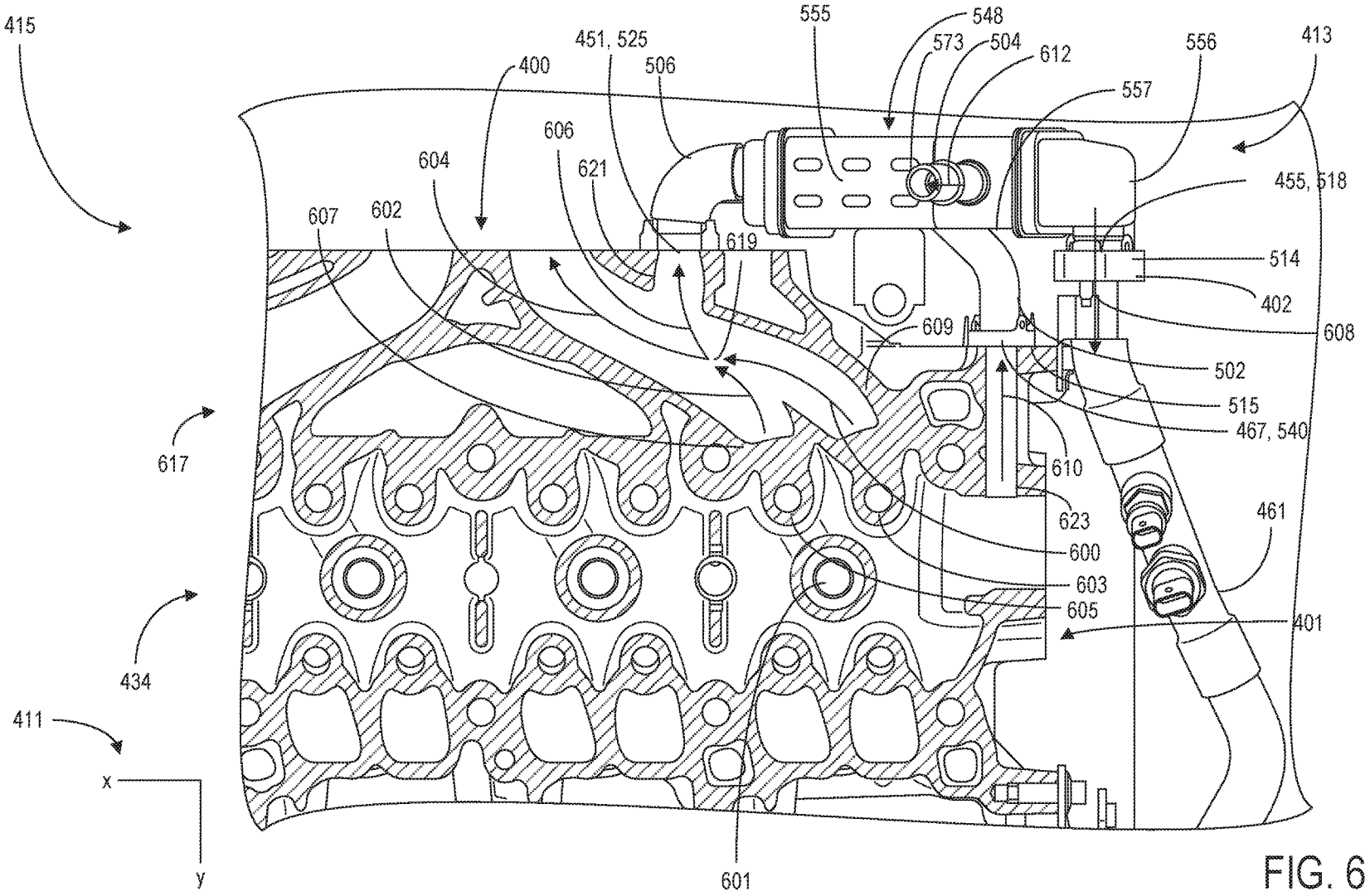
FIG. 6 shows an additional perspective view of the second embodiment of the EGR system including the EGR cooler module with the cylinder head shown in cross-section.
Figure 7:
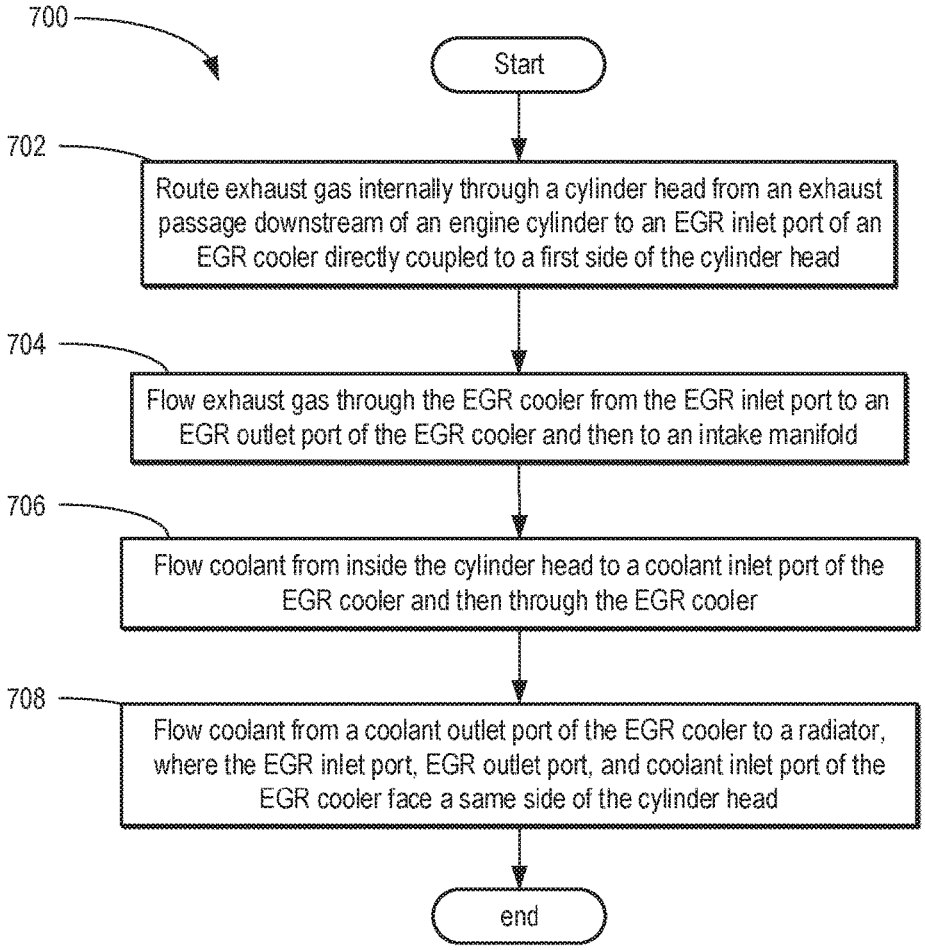
FIG. 7 shows a flow chart of a method for flowing exhaust gas and coolant through a cylinder head and EGR cooler mounted directly to a side of the cylinder head.

FIGS. 4-6 show a second embodiment of an EGR system including an EGR cooler module directly coupled to a side of a cylinder head of an engine system. Specifically, FIG. 4 shows a perspective view of a first side of a cylinder head in an arrangement similar to the cylinder head configuration described above during the discussion of FIG. 3. The cylinder head is included as part of a second embodiment of the EGR system shown by FIGS. 4-6. The second embodiment of the EGR system shown by FIGS. 4-6 is similar in arrangement to the EGR system included in the embodiment of the engine system shown by FIG. 3. FIG. 4 illustrates the first side of the cylinder head without the EGR cooler module attached to show the ports and mounting surfaces of the first side of the cylinder head. FIG. 5 shows in an alternate perspective view the same EGR system including the same cylinder head shown by FIG. 4, with the EGR cooler module directly coupled to two of the ports of the cylinder head. The EGR cooler module is also coupled to an external EGR passage and includes a port that may be coupled with an external coolant passage (not shown). FIG. 6 shows a third view of the EGR system including the cylinder head and EGR cooler shown by FIGS. 4-5, with the cylinder head shown in cross-section. The view shown by FIG. 6 illustrates the circulation paths of coolant and EGR gases between the EGR cooler module, the cylinder head, and the external passages, with the components of the EGR system in the same arrangement as shown by FIGS. 4-5. A shared set of axes are included in each of FIGS. 4-6 for comparison.

FIG. 4 shows a first perspective view of an embodiment of an EGR system 413 of an engine system 415 including a cylinder head 434 (e.g., such as the cylinder head 334 of FIG. 3) in a configuration similar to that shown by the schematic of FIG. 3. The cylinder head 434 includes a first cylinder head surface 400 (on a first side of the cylinder head) and a second cylinder head surface 401 (on a different, second side of the cylinder head). The first and second cylinder head surfaces are approximately perpendicular to each other (as shown by axes 411). The first cylinder head surface 400 includes two mounting surfaces 409 and 410 (e.g., first mounting surface 409 and second mounting surface 410). The mounting surfaces 409 and 410 are planar (e.g., flat) portions of the first cylinder head surface 400 and are parallel to each other. The first mounting surface 409 includes two eyelets (e.g., holes) 405 and 406, as well as a first engine EGR outlet port 451 (e.g., such as first engine EGR outlet port 151 shown in FIG. 3). The second mounting surface 410 includes two eyelets (e.g., holes) 407 and 408, as well as a first engine coolant outlet port 467 (e.g., such as first engine coolant outlet port 167 shown by FIG. 3). The eyelets of the first mounting surface 409 and the second mounting surface 410 (e.g., the eyelets 405 and 406, and the eyelets 407 and 408, respectively) are sized and shaped to accommodate bolts.

In the example of the embodiment of the EGR system 413 shown by FIG. 4, each mounting surface (409 and 410) has two eyelets. Alternate embodiments may exist in which each mounting surface has a different number of eyelets (e.g., three, four, etc.) and each mounting surface may have a different number of eyelets than the other mounting surface (e.g., first mounting surface 409 has a different number of eyelets than second mounting surface 410). The eyelets of the mounting surfaces 409 and 410 are formed such that each may accept a threaded end of a bolt.

FIG. 4 shows an external EGR passage 461 (e.g., such as external EGR passage 361 shown by FIG. 3). An external passage flange 402 is coupled to an end of the external EGR passage 461. An EGR inlet port 455 (e.g., such as EGR inlet port 355) is included in the external passage flange 402. The external EGR passage 461 and the external passage flange 402 are coupled (or formed together) such that fluid (e.g., EGR gases) may transfer through the EGR inlet port 455 and into the external EGR passage 461.

The external passage flange 402 also includes a plurality of eyelets (e.g., eyelets 403 and 404) sized and shaped to accommodate bolts. The eyelets (e.g., holes) of the external passage flange 402 are formed such that each may accept a threaded end of a bolt. In the example of the embodiment of the EGR system 413 shown by FIG. 4, the external passage flange 402 has two eyelets 403 and 404. Alternate embodiments may exist in which the external passage flange has a different number of eyelets (e.g., three, four, etc.).

FIG. 4 additionally includes an optional port 417 of the cylinder head 434. In the embodiment of the EGR system 413 shown by FIGS. 4-6, the optional port 417 is not utilized (e.g., the port is inactive and does not transfer fluid to/from the cylinder head). However, in alternate embodiments of the EGR system, the optional port may function as an engine coolant inlet port to facilitate the transfer of coolant from the EGR cooler module to an internal passage of the cylinder head. In this way, the EGR cooler may receive coolant from the first engine coolant outlet port and return coolant to the engine coolant inlet port (e.g., the optional port).

FIG. 5 shows a perspective view of the second embodiment of the EGR system shown by FIG. 4, and includes an EGR cooler module 548 mounted to the cylinder head 434. As described above, the embodiment of the EGR system 413 included in FIGS. 4-6, including EGR cooler module 548 directly coupled to cylinder head 434 (shown by FIG. 5), is similar in arrangement to the EGR system 301 shown by FIG. 3. The EGR cooler module 548 is mounted to the first cylinder head surface 400 of the cylinder head 434 in the configuration described during the discussion of FIGS. 3-4 above. The EGR cooler module 548 includes a housing 500, a plurality of rigid pipes (e.g., pipes 502, 504, and 506) and a plurality of flanges (e.g., flanges 514, 515, and 516). The housing, rigid pipes, and flanges of the EGR cooler module 548 may be constructed of a material (e.g., metal) resistant to wear by corrosion and/or high temperatures associated with engine fluids and gases. The housing, rigid pipes, flanges, and other components of the EGR cooler module may be formed together (e.g., molded) as one piece and/or may be fused together (e.g., welded). As introduced above, the housing (e.g., body) 500 of the EGR cooler module 548 includes a plurality of cooling tubes and exhaust passages disposed therein to facilitate the exchange of heat from exhaust gas to coolant.

In the example of the embodiment of the EGR cooler module 548 shown in FIG. 5, the housing 500 of the EGR cooler module 548 is formed such that the shape of the EGR cooler module 548 is approximately a rectangular parallelepiped. The housing 500 possesses an outward module surface 552 (e.g., outward facing surface relative to the cylinder head) that is parallel to the first cylinder head surface 400 of the cylinder head 434 when the EGR cooler module 548 is mounted to the cylinder head 434 (as described below). The outward module surface 552 is joined to a plurality of perpendicular module surfaces (e.g., surfaces 553, 554, 555, and 556) which are arranged perpendicular to the outward module surface 552. The perpendicular module surfaces are joined to an inward module surface 557 (e.g., facing the first cylinder head surface 400) which is arranged parallel to (and opposite from) the outward module surface 552. In the example of the embodiment of the EGR cooler module 548 shown by FIG. 5, the perpendicular module surfaces 553, 554, and 555 are planar (e.g., flat) while the perpendicular module surface 556 possesses a plurality of curves forming a curved end of the housing 500. The inward module surface 557 and outward module surface 552 are both planar (e.g., flat) and both the outward module surface 552 and the inward module surface 557 may be joined to the perpendicular surfaces with or without rounded edges. Alternate embodiments may exist in which the EGR cooler module possesses additional curves or fewer curves and/or has additional surfaces or fewer surfaces.

The housing 500 of the EGR cooler module 548 of FIG. 5 is directly coupled (e.g., formed as one piece or fused together) with the three rigid pipes 502, 504, and 506 (which may hereafter be referred to as the first module pipe 502, the second module pipe 504, and the third module pipe 506) of the EGR cooler module 548. A first end (e.g., an end originating from the housing) of the first module pipe 502 is coupled to a housing coolant inlet 565 of the housing 500. A first end (e.g., an end originating from the housing) of the second module pipe 504 is coupled to a housing coolant outlet 571 of the housing 500 and a first end (e.g., an end originating from the housing) of the third module pipe 506 is coupled to a housing EGR inlet 561 of the housing 500.

The rigid pipes 502, 504, and 506, and the housing coolant inlet 565, housing coolant outlet 571, and housing EGR inlet 561 in the example of the embodiment shown in FIG. 5 are arranged such that the housing inlets (565, 571, and 561) and first ends (as described above) of the pipes (502, 504, and 506) are positioned along the plurality of perpendicular module surfaces. The housing coolant inlet 565 (and the first end of the first module pipe 502) is positioned along the perpendicular module surface 553 (which may hereafter be referred to as first module perpendicular surface 553). The housing coolant outlet 571 (as well as the first end of the second module pipe 504) is positioned along the perpendicular surface 555 (which may hereafter be referred to as second module perpendicular surface 555). The housing EGR inlet 561 (as well as the first end of the third module pipe 506) is positioned along the perpendicular surface 554.

The flange 514 (which may be referred to as first module flange 514) is arranged parallel to the inward and outward module surfaces (557 and 552 respectively) and is joined with (e.g., formed from and/or welded to) the inward module surface 557. The first module flange 514 projects outward from the housing 500 of the EGR cooler module 548 away from the perpendicular module surface 556. The flange 515 (which may be referred to as second module flange 515) is arranged parallel to the inward and outward module surfaces (557 and 552 respectively) and is joined with (e.g., formed from and/or welded to) a second end (e.g., the end not originating from the housing 500) of the first module pipe 502. The second module flange 515 and the first module pipe 502 project outward from the housing 500 of the EGR cooler module 548 away from the perpendicular module surface 553. The flange 516 (which may be referred to as third module flange 516) is arranged parallel to the inward and outward module surfaces (557 and 552 respectively) and is joined with (e.g., formed from and/or welded to) a second end (e.g., the end not originating from the housing 500) of the third module pipe 506. The third module flange 516 and the third module pipe 506 project outward from the housing 500 of the EGR cooler module 548 away from the perpendicular module surface 554. Because the first module flange 514, the second module flange 515, and the third module flange 516 are simultaneously parallel to the inward and outward module surfaces (557 and 552 respectively), the first module flange 514, the second module flange 515, and the third module flange 516 are also parallel to each other. The first module flange 514, second module flange 515, and the third module flange 516, are all parallel to the first cylinder head surface 400 (and first side of the cylinder head).

The first module flange 514 includes a module EGR outlet port 518 fluidically coupled to (and in face-sharing contact with) the EGR inlet port 455 of the external EGR passage 461. In this arrangement, the module EGR outlet port 518 facilitates the flow of coolant from the EGR cooler module and into the EGR inlet port 455 of the external EGR passage 461.

The first module flange 514 also includes a plurality of eyelets (e.g., eyelets 524 and 526) sized and shaped to accommodate bolts. In the example of the embodiment of the first module flange 514 shown by FIG. 5, the first module flange 514 has two eyelets 524 and 526. Alternate embodiments may exist in which the first module flange has a different number of eyelets (e.g., three, four, etc.). The eyelets (e.g., holes) are configured on the first module flange 514 in an arrangement that matches the arrangement of the plurality of eyelets (e.g., eyelets 403 and 404 shown by FIG. 4) of the external passage flange 402. The eyelets 524 and 526 of the first module flange 514 in the embodiment shown in FIG. 5 are configured to align with the eyelets 403 and 404 when the first module flange 514 is directly coupled and in face-sharing contact with the external passage flange 402. The eyelets 403 and 404 are formed such that they may accept the threaded ends of the bolts passing through the eyelets 524 and 526.

The module EGR outlet port 518 of the first module flange 514 is configured such that when the first module flange 514 is directly coupled (e.g., bolted) to the external passage flange 402 of the external EGR passage 461, the module EGR outlet port 518 is in face-sharing contact with the EGR inlet port 455 of the external EGR passage 461. A gasket (not shown) may be secured between the first module flange 514 and the external passage flange 402 such that the gasket permits fluidic communication without leakage between the module EGR outlet port 518 and the EGR inlet port 455. The gasket may be formed from a material suitable for contact with corrosive and/or high-temperature gases from the cylinder head 434 (e.g., a rubber-like material).

The second module flange 515 includes a module coolant inlet port 540 fluidically and directly coupled to (and in face-sharing contact with) the first engine coolant outlet port 467 (as shown by FIG. 4) of the cylinder head 434. The module coolant inlet port 540 is also fluidically coupled to (and in face-sharing contact with) a second end (e.g., an end not originating from the housing 500) of the first module pipe 502. In this arrangement, the module coolant inlet port 540 facilitates the flow of coolant from the first engine coolant outlet port 467, through the first module pipe 502, and into the housing coolant inlet 565 of the housing 500.

The second module flange 515 also includes a plurality of eyelets (e.g., eyelets 544 and 546) sized and shaped to accommodate bolts. In the example of the embodiment of the second module flange 515 shown by FIG. 5, the second module flange 515 has two eyelets 544 and 546. Alternate embodiments may exist in which the second module flange has a different number of eyelets (e.g., three, four, etc.). The eyelets (e.g., holes) are configured on the second module flange 515 in an arrangement that matches the arrangement of the plurality of eyelets (e.g., eyelets 407 and 408) of the second mounting surface 410 of the cylinder head 434 (as shown by FIG. 4). The eyelets 544 and 546 of the second module flange 515 in the embodiment shown in FIG. 5 are configured to align with the eyelets 407 and 408 when the second module flange 515 is placed flush against the second mounting surface 410. The eyelets 407 and 408 are formed such that they may accept the threaded ends of the bolts passing through the eyelets 544 and 546.

The module coolant inlet port 540 of the second module flange 515 is configured such that when the second module flange 515 is bolted to the second mounting surface 410 of the cylinder head 434, the module coolant inlet port 540 is directly coupled to and in face-sharing contact with the first engine coolant outlet port 467 of the cylinder head 434. A gasket (not shown) may be secured between the second module flange 515 and the second mounting surface 410 such that the gasket permits fluidic communication without leakage between the module coolant inlet port 540 and the first engine coolant outlet port 467. The gasket may be formed from a material suitable for contact with corrosive and/or high-temperature fluids from the cylinder head 434 (e.g., a rubber-like material).

The third module flange 516 includes a module EGR inlet port 525 directly and fluidically coupled to (and in face-sharing contact with) the first engine EGR outlet port 451 (as shown by FIG. 4) of the cylinder head 434. The module EGR inlet port 525 is also fluidically coupled to (and in face-sharing contact with) a second end (e.g., an end not originating from the housing 500) of the third module pipe 506. In this arrangement, the module EGR inlet port 525 facilitates the flow of coolant from the first engine EGR outlet port 451, through the third module pipe 506, and into the housing EGR inlet 561 of the housing 500.

The third module flange 516 also includes a plurality of eyelets (e.g., eyelets 521 and 523) sized and shaped to accommodate bolts. In the example of the embodiment of the third module flange 516 shown by FIG. 5, the third module flange 516 has two eyelets 521 and 523. Alternate embodiments may exist in which the third module flange has a different number of eyelets (e.g., three, four, etc.). The eyelets (e.g., holes) are configured on the third module flange 516 in an arrangement that matches the arrangement of the plurality of eyelets (e.g., eyelets 405 and 406) of the first mounting surface 409 of the cylinder head 434 (as shown by FIG. 4). The eyelets 521 and 523 of the third module flange 516 in the embodiment shown in FIG. 5 are configured to align with the eyelets 405 and 406 when the third module flange 516 is coupled in face-sharing contact with the first mounting surface 409. The eyelets 405 and 406 are formed such that they may accept the threaded ends of the bolts passing through the eyelets 521 and 523.

The module EGR inlet port 525 of the third module flange 516 is configured such that when the third module flange 516 is directly coupled (e.g., bolted) to the first mounting surface 409 of the cylinder head 434, the module EGR inlet port 525 is in face-sharing contact with the first engine EGR outlet port 451 of the cylinder head 434. A gasket (not shown) may be secured between the third module flange 516 and the first mounting surface 409 such that the gasket permits fluidic communication without leakage between the module EGR inlet port 525 and the first engine EGR outlet port 451. The gasket may be formed from a material suitable for contact with corrosive and/or high-temperature fluids from the cylinder head 434 (e.g., a rubber-like material).

As described in the discussion of FIG. 3, the first engine EGR outlet port 451 is directly coupled to (e.g., formed by) an internal passage (e.g., such as internal passage 150 shown by FIG. 3) of the cylinder head 434, and the first engine coolant outlet port 467 is directly coupled to (e.g., formed by) an internal passage (e.g., such as internal passage 158 shown by FIG. 3) of the cylinder head 434.

By configuring the EGR cooler module 548 and cylinder head 434 in this way, the EGR cooler module 548 is able to receive coolant from the first engine coolant outlet port 467 of the cylinder head 434 via the module coolant inlet port 540 on the second module flange 515. The coolant flows out of the first engine coolant outlet port 467 of the cylinder head 434 and through the module coolant inlet port 540 into the first module pipe 502. The first module pipe 502 then directs the flow of coolant towards the housing coolant inlet 565 of the housing 500. Additionally, the EGR cooler module 548 is able to return coolant to a radiator (e.g., such as radiator 162 shown by FIG. 3) via an external coolant passage (e.g., such as second external coolant passage 372 shown by FIG. 3). The coolant flows out of the module coolant outlet port 571 and through the second module pipe 504. The second module pipe 504 then directs the flow of coolant to a module coolant outlet port 573 arranged within a second end (e.g., an end not originating from the housing 500) of the second module pipe 504. The module coolant outlet port 573 is in face-sharing contact and fluidically coupled with an inlet of an external coolant passage (e.g., such as second external coolant passage 372 shown by FIG. 3). The external coolant passage then directs coolant towards the radiator (e.g., such as radiator 162 shown by FIG. 3).

The EGR cooler module 548 using this configuration is also able to receive exhaust gases from the first engine EGR outlet port 451 of the cylinder head 434 via the module EGR inlet port 525 on the third module flange 516. The exhaust gas flows out of the first engine EGR outlet port 451 of the cylinder head 434 and through module EGR inlet port 525 (directly coupled to the first engine EGR outlet port 451) of the third module flange 516 into the EGR cooler module 548. Additionally, the EGR cooler module 548 is able to route cooled exhaust gas to the external EGR passage 461 via the module EGR outlet port 518 on the first module flange 514. The module EGR outlet port 518 is fluidically (and directly) coupled to the EGR inlet port 455 of the external passage flange 402 and directs the flow of cooled exhaust gas into the external EGR passage 461.

In this configuration, the second and third flanges (515 and 516) of the EGR cooler module 548 may be directly coupled (e.g., bolted) to the first cylinder head surface 400 of the cylinder head 434 so that the ports (e.g., module coolant inlet port 540 and module EGR inlet port 525) of the second and third flanges (respectively) of the EGR cooler module 548 are in face-sharing contact (and fluidically coupled) with the corresponding ports (e.g., first engine coolant outlet port 467 and first engine EGR outlet port 451) of the cylinder head to facilitate the transfer of coolant and EGR gas into the EGR cooler module 548. This eliminates the use of extra fittings and/or passages for routing fluids into the EGR cooler module 548 and achieves a compact form for the EGR cooler module 548.

FIG. 6 shows an additional perspective view of the embodiment of the EGR system 413 included in the engine system 415 shown by FIGS. 4-5. FIG. 6 shows the cylinder head 434 in cross-section with the EGR cooler module 548 directly coupled to the first cylinder head surface 400 of the cylinder head 434. The perspective shown by FIG. 6 is approximately perpendicular to that shown by FIGS. 4-5 (as indicated by axes 411). The flow of gas and coolant through the cylinder head 434 is shown by a plurality of arrows indicating the direction of flow.

The cylinder head 434 of the engine system 415 interfaces with a plurality of cylinders, such as cylinder 601. While a four-cylinder configuration is shown in the embodiment of engine system 415, other embodiments may include a different number of cylinders (e.g., three, six, eight, etc.). Each cylinder is shown coupled to a plurality of exhaust ports that direct flow to a plurality of exhaust runners. While the cylinders in the embodiment of the engine system 415 and EGR system 413 shown by FIG. 6 are coupled to two exhaust ports and two exhaust runners each, other embodiments may show each cylinder coupled to a different number of exhaust ports and/or exhaust runners (e.g., one, three, etc.).

The cylinder 601 is shown coupled to exhaust ports 603 and 605. The cylinder 601 may exhaust gases through exhaust ports 603 and 605 via an exhaust valve disposed within each exhaust port (as described in the discussion of FIG. 3). Exhaust port 603 is fluidically coupled to exhaust runner 609 and exhaust port 605 is fluidically coupled to exhaust runner 607 as part of an integrated exhaust manifold (IEM) 617. The flow of exhaust from cylinder 601 through exhaust runner 609 is indicated approximately by arrow 600. The flow of exhaust from cylinder 601 through exhaust runner 607 is indicated approximately by arrow 602. The flows as indicated by arrows 600 and 602 mix and converge at an internal exhaust junction 619 within the IEM 617.

A peripheral exhaust passage 621 (e.g., similar to first internal passage 150 shown by FIG. 3) is fluidically coupled to the internal exhaust junction 619 and the first engine EGR outlet port 451. A portion of the exhaust gases from cylinder 601 (e.g., the portion of gases not flowing in the direction of arrow 604) flow through the peripheral exhaust passage 621 along a path approximately indicated by the arrow 606. The gases flow through the first engine EGR outlet port 451 and into the EGR cooler module 548 via module EGR inlet port 525, as described by the discussion of FIG. 5 above. The exhaust gases route through the EGR cooler module 548 and experience a reduction in thermal energy due to the proximity of the gases with the coolant passages included within (e.g., internal to) the EGR cooler module 548, as described by the discussion of FIG. 3 above. The cooled exhaust gas then exits the EGR cooler module 548 via the module EGR outlet port 518 and enters the external EGR passage 461 via a direct coupling between the module EGR outlet port 518 and the EGR inlet port 455, as described by the discussion of FIG. 5 above and as indicated by the flow direction arrow 608.

The embodiment of the EGR system 413 shown by FIG. 6 includes the peripheral exhaust passage 621 fluidically coupled to the exhaust flow downstream of the cylinder 601 and not downstream of additional engine cylinders. Said another way, as shown in FIG. 6, the peripheral exhaust passage 621 is fluidly coupled to only one cylinder (cylinder 601) of the engine. However, other embodiments may include the peripheral exhaust passage 621 being coupled downstream of one or more or each of the engine cylinders. The peripheral exhaust passage 621 may also be arranged downstream of a different cylinder, or downstream of a different cylinder and one or more or each of the cylinders additional to the fluidically coupled cylinder.

Coolant exits the cylinder head 434 and enters the EGR cooler module 548 via module coolant inlet port 540 from a passage 623 (e.g., such as third internal passage 158 shown by FIG. 3) internal to the cylinder head 434 (e.g., a passage passing through an interior of the cylinder head). The coolant exits the cylinder head via first engine coolant outlet port 467 and enters the EGR cooler module 548 via the module coolant inlet port 540, as described by the discussion of FIG. 5 and indicated by the flow direction arrow 610. The coolant receives thermal energy from the exhaust gas within the EGR cooler module 548 via a plurality of proximate passages as described by the discussion of FIG. 3. The coolant then exits the EGR cooler module 548 and enters an external coolant passage (not shown) via the module coolant outlet port 573 as described by the discussion of FIG. 5 and as indicated by the flow direction arrow 612.

FIG. 2 and FIGS. 4-6 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

FIG. 7 depicts a flowchart 700 describing a method for routing exhaust gases from cylinders of a cylinder head and through an EGR system including an EGR cooler module, such as EGR system 201 and EGR cooler module 248 shown in FIG. 2 or EGR system 413 and EGR cooler module 548 shown by FIGS. 5-6.

At 702, the method includes routing exhaust gas internally through a cylinder head from an exhaust passage downstream of an engine cylinder to an EGR inlet port (e.g., module EGR inlet port 220 shown in FIG. 2 or module EGR inlet port 525 shown in FIGS. 5-6) of an EGR cooler directly coupled to a first side of the cylinder head. For example, exhaust gas may be routed through an exhaust passage internal to the cylinder head (e.g., first internal passage 150 shown by FIG. 1 and FIG. 3) and into an EGR cooler module (e.g., EGR cooler module 248 shown by FIG. 2 or EGR cooler module 548 shown by FIGS. 5-6) via the respective inlet ports described above.

At 704, the method includes flowing exhaust gas through the EGR cooler from the EGR inlet port to an EGR outlet port (e.g., module EGR outlet port 242 shown in FIG. 2 or module EGR outlet port 518 shown in FIGS. 5-6) of the EGR cooler (e.g., EGR cooler module 248 shown by FIG. 2 or EGR cooler module 548 shown by FIGS. 5-6) and then to an intake manifold. In a first embodiment, flowing exhaust to the intake manifold at 704 includes internally routing exhaust gas through the cylinder head from the EGR outlet port to a cylinder head outlet port (e.g., second engine EGR outlet port 154 shown in FIG. 1) coupled to the intake manifold. For example, in the first embodiment, the EGR cooler module (e.g., EGR cooler module 248 shown by FIG. 2) receives exhaust gas flow at a module EGR inlet port (e.g, module EGR inlet port 220 shown by FIG. 2) and outputs cooled exhaust gas to a module EGR outlet port (e.g., module EGR outlet port 242 shown by FIG. 2). The gas then flows through a passage (e.g., second internal passage 152 shown by FIG. 1) internal to a cylinder head (e.g., cylinder head 235 shown by FIG. 2) to an intake manifold (e.g., intake manifold 106 shown by FIG. 1). In a second embodiment, flowing gas to the intake manifold includes flowing exhaust gas from the EGR outlet port of the EGR cooler and externally to the intake manifold via an external EGR passage arranged outside of the cylinder head. For example, in the second embodiment, the EGR cooler module (e.g., EGR cooler module 548 shown by FIG. 5) receives exhaust gas flow at a module EGR inlet port (e.g, module EGR inlet port 525 shown by FIG. 5) and outputs cooled exhaust gas to a module EGR outlet port (e.g., module EGR outlet port 518 shown by FIG. 5). The cooled gas then flows from the module EGR outlet port into an external EGR passage (e.g., external EGR passage 461 shown by FIGS. 4-6) via an EGR inlet port (e.g., EGR inlet port 455) of the external EGR passage.

At 706, the method includes flowing coolant from inside the cylinder head to a coolant inlet port (e.g., module coolant inlet port 218 show by FIG. 2, or module coolant inlet port 540 shown by FIGS. 5-6) of the EGR cooler (e.g., EGR cooler module 248 shown by FIG. 2 or EGR cooler module 548 shown by FIGS. 5-6) and then through the EGR cooler. For example, coolant may be routed through a coolant passage internal to the cylinder head (e.g., third internal passage 158 shown by FIG. 1 and FIG. 3) and into the EGR cooler module via an engine coolant outlet port (e.g., first engine coolant outlet port 167 shown by FIG. 1 and FIG. 3) directly coupled to a module coolant inlet port (e.g., module coolant inlet port 218 shown by FIG. 2, or module coolant inlet port 540 shown by FIGS. 5-6) of the EGR cooler module.

At 708, the method includes flowing coolant from a coolant outlet port (e.g., module coolant outlet port 240 shown by FIG. 2, or module coolant outlet port 573 shown by FIGS. 5-6) of the EGR cooler to a radiator, where the EGR inlet port, EGR outlet port, and coolant inlet port of the EGR cooler face a same side of the cylinder head. In a first embodiment, the method at 708 includes flowing coolant from the coolant outlet port to the radiator by internally routing coolant through the cylinder head from the coolant outlet port to a cylinder head outlet port coupled to the radiator. For example, coolant may flow from the coolant outlet port (e.g., module coolant outlet port 240 shown by FIG. 2) of the EGR cooler module (e.g., EGR cooler module 248 shown by FIG. 2), to an internal coolant passage (e.g., fourth internal passage 168 shown by FIG. 1) internal to the cylinder head, through a coolant outlet port (e.g., second engine coolant outlet port 170 shown by FIG. 1), and into the radiator (e.g., radiator 162 shown by FIG. 1). In a second embodiment, the method at 708 includes flowing coolant from the coolant outlet port to the radiator via an external coolant passage arranged outside of the cylinder head. For example, coolant may flow from the coolant outlet port (e.g., module coolant outlet port 573 shown by FIGS. 5-6) of the EGR cooler module (e.g., EGR cooler module 548 shown by FIGS. 5-6), to the external coolant passage (e.g., second external coolant passage 372 shown by FIG. 3) external to the cylinder head, and into the radiator (e.g., radiator 162 shown by FIG. 3).

In this way, an EGR cooler module included in an EGR system may be directly mounted to a single side of a cylinder head of an engine. The EGR cooler module may be directly coupled (e.g., mounted) to a plurality of inlet/outlet ports included in the single side of the cylinder head in order to form interfaces between the inlet/outlet ports of the EGR cooler module and the corresponding inlet/outlet ports of the cylinder head. The technical effect of directly mounting the EGR cooler module to a single side of the cylinder head and forming interfaces between the corresponding inlet/outlet ports is to permit the transfer of coolant and EGR gases from the cylinder head to the EGR cooler module inlet ports, and to permit the transfer of coolant and EGR gases from the EGR module outlet ports to the radiator and the intake manifold respectively. In this way, additional external fittings for coupling the EGR cooler to the passages of the cylinder head are not needed, thereby increasing ease of installation and reducing degradation of the fittings over time. Further, the arrangement described above may reduce overall packaging space of the engine. The transfer of coolant/EGR gas from the cylinder head to the EGR cooler module inlet ports is accomplished by directly coupling the module inlet ports to corresponding cylinder head outlet ports fluidically coupled with coolant/EGR gas passages internal to the cylinder head. The transfer of coolant/EGR gas from EGR cooler module to the radiator and intake manifold is accomplished by coupling the EGR cooler module outlet ports to additional coolant/EGR passages internal to the cylinder head (as in a first embodiment) or coupling the EGR cooler module outlet ports to coolant/EGR passages external to the cylinder head (as in a second embodiment).

In one embodiment, an exhaust gas recirculation (EGR) system includes an EGR cooler module including a body and an EGR inlet port, EGR outlet port, and coolant inlet port, all extending from the body and arranged in parallel with one another and at a same, first side of a cylinder head, where the EGR inlet port and coolant inlet port are directly coupled to the first side of the cylinder head. In a first example of the exhaust gas recirculation (EGR) system, the EGR outlet port is directly coupled to an engine EGR inlet port, the EGR inlet port is directly coupled to an engine EGR outlet port arranged in the first side of the cylinder head, and the coolant inlet port is directly coupled to an engine coolant outlet port arranged in the first side of the cylinder head. A second example of the exhaust gas recirculation (EGR) system optionally includes the first example and further includes wherein the engine EGR outlet port is directly coupled to an internal EGR passage routed through an inside of the cylinder head from the engine EGR outlet port to an exhaust passage downstream of a cylinder and within the cylinder head. A third example of the exhaust gas recirculation (EGR) system optionally includes one or more or both of the first and second examples, and further includes wherein the exhaust passage is an exhaust runner of only one cylinder of a plurality of engine cylinders and wherein only exhaust gas from the one cylinder is routed through the EGR cooler module. A fourth example of the exhaust gas recirculation (EGR) system optionally includes one or more or each of the first through third examples, and further includes wherein the engine coolant outlet port is directly coupled to a first internal coolant passage routed through an inside of the cylinder head from a second internal coolant passage circulating coolant around cylinders of the engine and the engine coolant inlet port. A fifth example of the exhaust gas recirculation (EGR) system optionally includes one or more or each of the first through fourth examples, and further includes wherein the engine EGR inlet port includes a flange coupled to an external EGR pipe coupled between the EGR outlet port and an intake manifold of the engine. A sixth example of the exhaust gas recirculation (EGR) system optionally includes one or more or each of the first through fifth examples, and further includes wherein the external EGR pipe includes an EGR valve disposed therein. A seventh example of the exhaust gas recirculation (EGR) system optionally includes one or more or each of the first through sixth examples, and further includes wherein the engine EGR inlet port is arranged in the first side of the cylinder head. An eighth example of the exhaust gas recirculation (EGR) system optionally includes one or more or each of the first through seventh examples, and further includes wherein the engine EGR inlet port is directly coupled to an internal EGR passage routed through an inside of the cylinder head from the engine EGR inlet port to a cylinder head exit port arranged at a second side of the cylinder block and coupled to an external EGR passage coupled between the cylinder head exit port and an intake manifold of the engine. A ninth example of the exhaust gas recirculation (EGR) system optionally includes one or more or each of the first through eighth examples, and further includes wherein the EGR cooler module further includes a coolant outlet port directly coupled to an engine coolant inlet port arranged in the first side of the cylinder block, the engine coolant inlet port directly coupled to an internal coolant passage routed through an inside of the cylinder block. A tenth example of the exhaust gas recirculation (EGR) system optionally includes one or more or each of the first through ninth examples, and further includes wherein the EGR cooler module further includes a coolant outlet port directly coupled to an external coolant passage routing coolant from the EGR cooler module to a radiator.

A method for an exhaust gas recirculation (EGR) system includes routing exhaust gas internally through a cylinder head from an exhaust passage downstream of an engine cylinder to an EGR inlet port of an EGR cooler directly coupled to a first side of the cylinder head; flowing exhaust gas through the EGR cooler from the EGR inlet port to an EGR outlet port of the EGR cooler and then to an intake manifold; flowing coolant from inside the cylinder head to a coolant inlet port of the EGR cooler and then through the EGR cooler; and flowing coolant from a coolant outlet port of the EGR cooler to a radiator, where the EGR inlet port, EGR outlet port, and coolant inlet port of the EGR cooler face a same side of the cylinder head. In a first example of the method, the method includes flowing exhaust gas to the intake manifold includes flowing exhaust gas from the EGR outlet port of the EGR cooler to the intake manifold via an external EGR passage arranged outside of the cylinder head. A second example of the method optionally includes the first example and further includes adjusting a flow of exhaust gas from the exhaust passage to the intake manifold via adjusting a position of an EGR valve arranged in the external EGR passage. A third example of the method optionally includes one or more or both of the first and second examples, and further includes wherein flowing exhaust to the intake manifold includes internally routing exhaust gas through the cylinder head from the EGR outlet port to a cylinder head outlet port coupled to the intake manifold. A fourth example of the method optionally includes one or more or each of the first through third examples, and further includes adjusting a flow of exhaust gas from the exhaust passage to the intake manifold via adjusting a position of an EGR valve arranged in a passage coupled between the cylinder head outlet port and the intake manifold. A fifth example of the method optionally includes one or more or each of the first through fourth examples, and further includes wherein flowing coolant from the coolant outlet port to the radiator includes flowing coolant from the coolant outlet port to the radiator via an external coolant passage arranged outside of the cylinder head. A sixth example of the method optionally includes one or more or each of the first through fifth examples, and further includes wherein flowing coolant from the coolant outlet port to the radiator includes internally routing coolant through the cylinder head from the coolant outlet port to a cylinder head outlet port coupled to the radiator.

In another embodiment, an exhaust gas recirculation (EGR) system includes an EGR cooler module including a housing including a body and four engine connection ports including a module EGR inlet port, module EGR outlet port, module coolant inlet port, and module coolant outlet port, the four connection ports extending from the body and all arranged in a common plane; and a cylinder head including a single side having four module connection ports including an engine EGR outlet port shaped to couple with the module EGR inlet port, an engine EGR inlet port shaped to couple with the module EGR outlet port, an engine coolant outlet port shaped to couple with the module coolant inlet port, and an engine coolant inlet port shaped to couple with the module coolant outlet port. In a first example of the exhaust gas recirculation (EGR) system, the cylinder head includes a first internal passage within an interior of the cylinder head and coupled between an exhaust passage downstream of an engine cylinder and the engine EGR outlet port, where exhaust gases are routed internally through the cylinder head via the first internal passage and to the EGR cooler module.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An exhaust gas recirculation (EGR) system, comprising:

an EGR cooler module including a body and an EGR inlet port, an EGR outlet port, and a coolant inlet port, all extending from the body and arranged in parallel with one another and at a same, first side of a cylinder head, where the EGR inlet port and the coolant inlet port are directly coupled to the first side of the cylinder head, the EGR inlet port arranged at the first side of the cylinder head, the EGR cooler module including a first flange with the EGR inlet port and the coolant inlet port, the coolant inlet port in fluidic communication with an engine coolant outlet port at the first flange, and the EGR cooler module further including a second flange, separate from the first flange, having the EGR outlet port and a module coolant outlet port; and a radiator coupled to the module coolant outlet port via an internal passage of the cylinder head.

2. The EGR system of claim 1, wherein the EGR outlet port is directly coupled to an engine EGR inlet port, the EGR inlet port is directly coupled to an engine EGR outlet port arranged at the first side of the cylinder head, and the coolant inlet port is directly coupled to an engine coolant outlet port arranged at the first side of the cylinder head.

3. The EGR system of claim 2, wherein the engine EGR outlet port is directly coupled to an internal EGR passage routed through an inside of the cylinder head from the engine EGR outlet port to an exhaust passage downstream of a cylinder and within the cylinder head.

4. The EGR system of claim 3, wherein the exhaust passage is an exhaust runner of only one cylinder of a plurality of engine cylinders and wherein only exhaust gas from the one cylinder is routed through the EGR cooler module.

5. The EGR system of claim 2, wherein the engine coolant outlet port is directly coupled to a first internal coolant passage routed through an inside of the cylinder head from a second internal coolant passage circulating coolant around cylinders of an engine and to the coolant inlet port.

6. The EGR system of claim 2, further comprising a first gasket between the first flange and the cylinder head, and a second gasket between the second flange and the cylinder head.

7. The EGR system of claim 2, further comprising a first gasket between the first flange and the cylinder head, and a second gasket between the second flange and the cylinder head, in a common plane.

8. The EGR system of claim 7, wherein the engine EGR inlet port is directly coupled to an internal EGR passage routed through an inside of the cylinder head from the engine EGR inlet port to a cylinder head exit port arranged at a second side of the cylinder head and coupled to an external EGR passage coupled between the cylinder head exit port and an intake manifold of an engine.

9. The EGR system of claim 2, wherein the module coolant outlet port is directly coupled to an engine coolant inlet port arranged at the first side of the cylinder head, the engine coolant inlet port directly coupled to an internal coolant passage routed through an inside of the cylinder head.

10. The EGR system of claim 1, wherein the module coolant outlet port is directly coupled to the internal passage of the cylinder head.

11. A method, comprising:

routing exhaust gas internally through a cylinder head from an exhaust passage downstream of an engine cylinder through a first flange and a first gasket to an EGR inlet port of an EGR cooler directly coupled, via the first flange, to a first side of the cylinder head;

flowing exhaust gas through the EGR cooler from the EGR inlet port, through the first flange and the first gasket, to an EGR outlet port of the EGR cooler and then through a second flange and a second gasket, to the cylinder head and then to an intake manifold, the EGR outlet port directly coupled, via the second flange, to the first side of the cylinder head;

flowing coolant from inside the cylinder head and then through the first flange to a coolant inlet port of the EGR cooler and then through the EGR cooler; and flowing coolant from a coolant outlet port of the EGR cooler, through the second flange, to a radiator via an internal passage of the cylinder head, where the EGR inlet port, the EGR outlet port, and the coolant inlet port of the EGR cooler face a same side of the cylinder head.

12. The method of claim 11, wherein flowing exhaust gas to the intake manifold includes flowing exhaust gas from the EGR outlet port of the EGR cooler to the intake manifold via an EGR passage.

13. The method of claim 12, further comprising adjusting a flow of exhaust gas from the exhaust passage to the intake manifold via adjusting a position of an EGR valve.

14. The method of claim 11, wherein flowing exhaust gas to the intake manifold includes internally routing exhaust gas through the cylinder head from the EGR outlet port to a cylinder head outlet port coupled to the intake manifold.

15. The method of claim 14, further comprising adjusting a flow of exhaust gas from the exhaust passage to the intake manifold via adjusting a position of an EGR valve arranged in a passage coupled between the cylinder head outlet port and the intake manifold.

16. The method of claim 11, wherein flowing coolant from the coolant outlet port to the radiator includes internally routing coolant through the internal passage of the cylinder head from the coolant outlet port to a cylinder head outlet port coupled to the radiator.

17. An EGR system, comprising:

an EGR cooler module including a housing including a body and four engine connection ports including a module EGR inlet port, a module EGR outlet port, a module coolant inlet port, and a module coolant outlet port, the four engine connection ports extending from the body and all arranged in a common plane, the module EGR inlet port and the module coolant inlet port positioned through a first flange, and the module EGR outlet port and the module coolant outlet port positioned through a second flange spaced away and separate and different from the first flange;

a cylinder head including a single side having four module connection ports including an engine EGR outlet port shaped to couple with the module EGR inlet port, an engine EGR inlet port shaped to couple with the module EGR outlet port, an engine coolant outlet port shaped to couple with the module coolant inlet port, and an engine coolant inlet port shaped to couple with the module coolant outlet port, a first gasket between the cylinder head and the first flange, and a second gasket between the cylinder head and the second flange; and a radiator coupled to the module coolant outlet port via an internal passage of the cylinder head.

18. The EGR system of claim 17, wherein the cylinder head includes an internal gas passage within an interior of the cylinder head and coupled between an exhaust passage downstream of an engine cylinder and the engine EGR outlet port, and where exhaust gases are routed internally through the cylinder head via the internal gas passage and to the EGR cooler module.

* * * * *